US006118956A

United States Patent [19]

Hirao

[11] Patent Number: 6,118,956

[45] Date of Patent: Sep. 12, 2000

[54] DUPLEX PRINTING APPARATUS AND CONTROL METHOD OF THE SAME APPARATUS

[75] Inventor: Naoto Hirao, Kawasaki, Japan

[73] Assignee: Fujitsu Limited, Kawasaki, Japan

[21] Appl. No.: 09/337,271

[22] Filed: Jun. 22, 1999

[30] Foreign Application Priority Data

Dec. 8, 1998 [JP] Japan ..... 10-348490

[51] Int. Cl.[7] ..... G03G 15/00

[52] U.S. Cl. ..... 399/85; 399/306

[58] Field of Search ..... 399/309, 364, 399/384, 401, 85, 402, 306, 82

[56] References Cited

U.S. PATENT DOCUMENTS

| | | | |
|---|---|---|---|
| 3,536,398 | 10/1970 | Bhagat . | |
| 3,944,359 | 3/1976 | Fisk et al. | 399/77 |
| 4,609,279 | 9/1986 | Hausmann et al. . | |
| 4,958,187 | 9/1990 | Tsuchiya et al. | 399/306 |
| 5,455,668 | 10/1995 | De Bock et al. . | |
| 5,461,470 | 10/1995 | De Cock et al. . | |
| 5,548,390 | 8/1996 | Sugisaki et al. . | |
| 5,550,624 | 8/1996 | Wachtler | 399/306 |
| 5,623,719 | 4/1997 | De Cock et al. . | |
| 5,671,475 | 9/1997 | De Cock et al. . | |
| 5,701,565 | 12/1997 | Morgan | 399/299 |
| 5,740,510 | 4/1998 | Bogaert et al. | 399/298 |
| 5,797,077 | 8/1998 | Samizo et al. | 399/309 |
| 5,905,930 | 5/1999 | Toyama et al. | 399/299 |
| 5,974,297 | 10/1999 | Creutzmann et al. | 399/384 |

FOREIGN PATENT DOCUMENTS

| | | |
|---|---|---|
| 54-138445 | 10/1979 | Japan . |
| 56-88161 | 7/1981 | Japan . |
| 58-173774 | 10/1983 | Japan . |
| 60-201954 | 10/1985 | Japan . |
| 61-20075 | 1/1986 | Japan . |
| 7-72776 | 3/1995 | Japan . |
| 7-77851 | 3/1995 | Japan . |
| 7-334061 | 12/1995 | Japan . |
| 8-6346 | 1/1996 | Japan . |
| 10-6583 | 1/1998 | Japan . |

*Primary Examiner*—Robert Beatty
*Attorney, Agent, or Firm*—Armstrong, Westerman, Hattori, McLeland & Naughton

[57] ABSTRACT

The present invention is a duplex printing apparatus, which is equipped with a first image forming process unit, a second image forming process unit, a fixing section, a conveyance system, and said fixing section, and a control section. In making a switch-over between printing modes (one-sided copying, both-sided copying), the control section fixes by the fixing section the unfixed toner image on the medium formed in the printing mode preceding before the switch-over and then conveys the medium by the conveyance system to a printing start position in the printing mode following after the switch-over. With this, in making a switch-over between printing modes, even when the medium is fed back, there is no possibility that the unfixed toner image formed on the medium will be disturbed. Therefore, printing quality can be maintained and printing can be performed on the medium without waste.

48 Claims, 4 Drawing Sheets

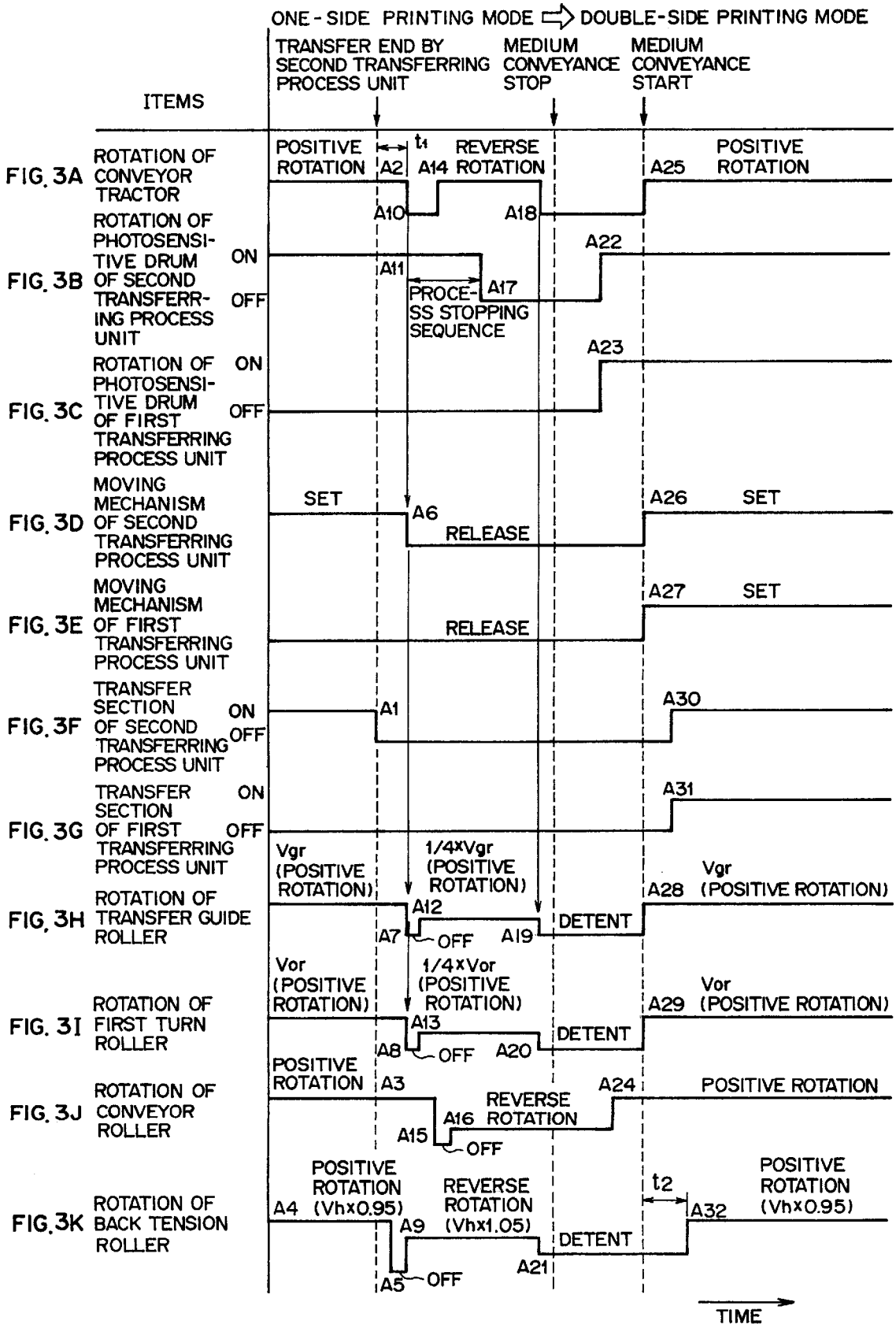
ONE-SIDE PRINTING MODE ⇨ DOUBLE-SIDE PRINTING MODE
TRANSFER END BY SECOND TRANSFERRING PROCESS UNIT
MEDIUM CONVEYANCE STOP
MEDIUM CONVEYANCE START
ITEMS
FIG. 3A ROTATION OF CONVEYOR TRACTOR
POSITIVE ROTATION
t1
A2
A14
REVERSE ROTATION
A25
POSITIVE ROTATION
A10
A18
FIG. 3B ROTATION OF PHOTOSENSITIVE DRUM OF SECOND TRANSFERRING PROCESS UNIT
ON
OFF
A22
A11
A17
PROCESS STOPPING SEQUENCE
FIG. 3C ROTATION OF PHOTOSENSITIVE DRUM OF FIRST TRANSFERRING PROCESS UNIT
ON
OFF
A23
FIG. 3D MOVING MECHANISM OF SECOND TRANSFERRING PROCESS UNIT
SET
A6
RELEASE
A26
SET
FIG. 3E MOVING MECHANISM OF FIRST TRANSFERRING PROCESS UNIT
RELEASE
A27
SET
FIG. 3F TRANSFER SECTION OF SECOND TRANSFERRING PROCESS UNIT
ON
OFF
A1
A30
FIG. 3G TRANSFER SECTION OF FIRST TRANSFERRING PROCESS UNIT
ON
OFF
A31
FIG. 3H ROTATION OF TRANSFER GUIDE ROLLER
Vgr (POSITIVE ROTATION)
1/4xVgr (POSITIVE ROTATION)
A12
A7
OFF
A19
DETENT
A28
Vgr (POSITIVE ROTATION)
FIG. 3I ROTATION OF FIRST TURN ROLLER
Vor (POSITIVE ROTATION)
1/4xVor (POSITIVE ROTATION)
A13
A8
OFF
A20
DETENT
A29
Vor (POSITIVE ROTATION)
FIG. 3J ROTATION OF CONVEYOR ROLLER
POSITIVE ROTATION
A3
A16
REVERSE ROTATION
A15
OFF
A24
POSITIVE ROTATION
FIG. 3K ROTATION OF BACK TENSION ROLLER
A4
POSITIVE ROTATION (Vhx0.95)
A9
REVERSE ROTATION (Vhx1.05)
A5
OFF
A21
DETENT
t2
A32
POSITIVE ROTATION (Vhx0.95)
TIME

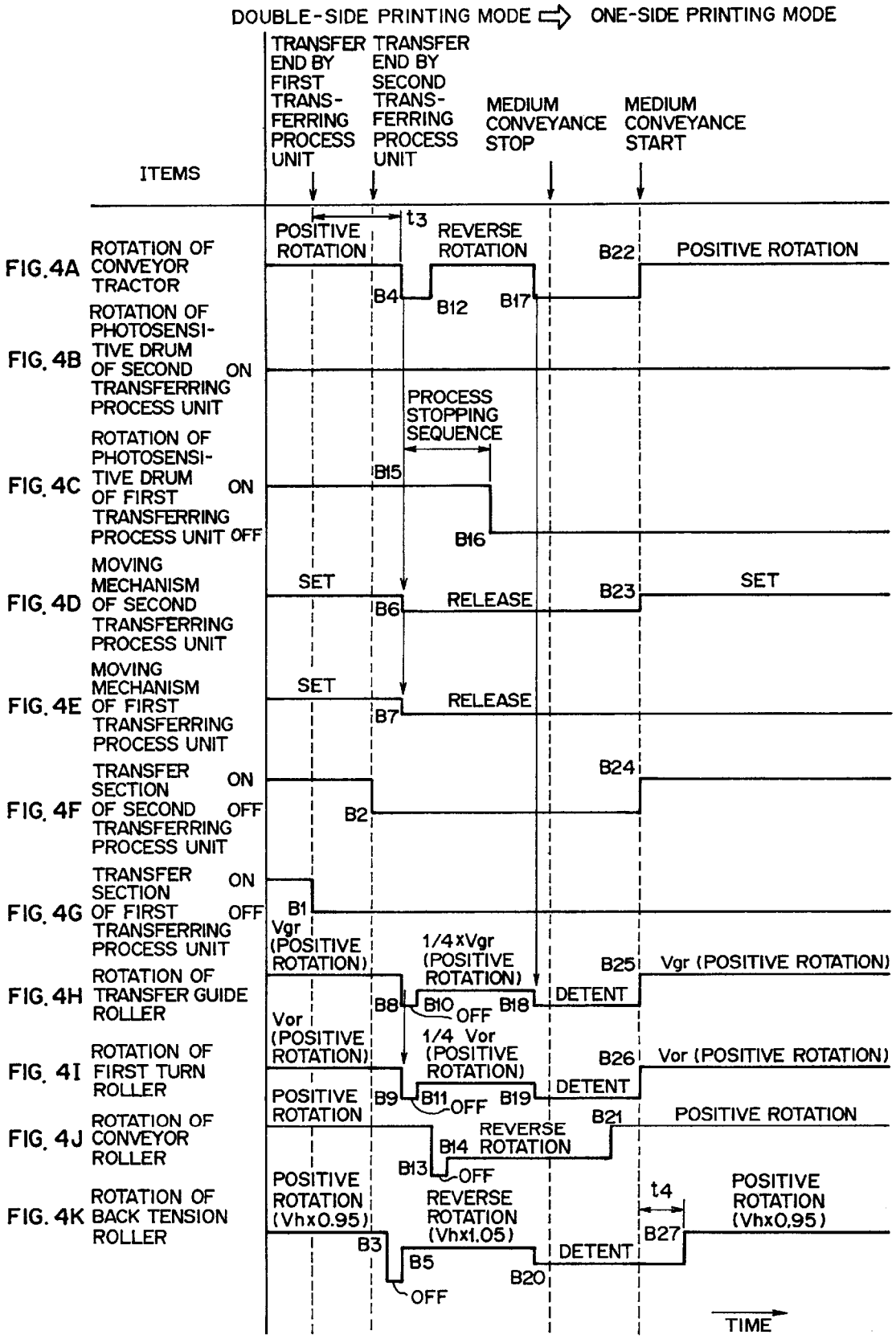
DOUBLE-SIDE PRINTING MODE ⇨ ONE-SIDE PRINTING MODE
TRANSFER END BY FIRST TRANSFERRING PROCESS UNIT
TRANSFER END BY SECOND TRANSFERRING PROCESS UNIT
MEDIUM CONVEYANCE STOP
MEDIUM CONVEYANCE START
ITEMS
FIG.4A ROTATION OF CONVEYOR TRACTOR
POSITIVE ROTATION
t3
REVERSE ROTATION
B22
POSITIVE ROTATION
B4
B12
B17
FIG. 4B ROTATION OF PHOTOSENSITIVE DRUM OF SECOND TRANSFERRING PROCESS UNIT
ON
PROCESS STOPPING SEQUENCE
FIG. 4C ROTATION OF PHOTOSENSITIVE DRUM OF FIRST TRANSFERRING PROCESS UNIT
ON
OFF
B15
B16
FIG. 4D MOVING MECHANISM OF SECOND TRANSFERRING PROCESS UNIT
SET
RELEASE
B23
SET
B6
FIG. 4E MOVING MECHANISM OF FIRST TRANSFERRING PROCESS UNIT
SET
RELEASE
B7
FIG. 4F TRANSFER SECTION OF SECOND TRANSFERRING PROCESS UNIT
ON
OFF
B24
B2
FIG. 4G TRANSFER SECTION OF FIRST TRANSFERRING PROCESS UNIT
ON
OFF
B1
FIG. 4H ROTATION OF TRANSFER GUIDE ROLLER
Vgr (POSITIVE ROTATION)
1/4xVgr (POSITIVE ROTATION)
B25
Vgr (POSITIVE ROTATION)
B8
B10
OFF
B18
DETENT
FIG. 4I ROTATION OF FIRST TURN ROLLER
Vor (POSITIVE ROTATION)
1/4 Vor (POSITIVE ROTATION)
B26
Vor (POSITIVE ROTATION)
B9
B11
OFF
B19
DETENT
FIG. 4J ROTATION OF CONVEYOR ROLLER
POSITIVE ROTATION
B21
POSITIVE ROTATION
B14
REVERSE ROTATION
B13
OFF
FIG. 4K ROTATION OF BACK TENSION ROLLER
POSITIVE ROTATION (Vhx0.95)
REVERSE ROTATION (Vhx1.05)
t4
POSITIVE ROTATION (Vhx0.95)
B27
B3
B5
OFF
B20
DETENT
TIME

DUPLEX PRINTING APPARATUS AND CONTROL METHOD OF THE SAME APPARATUS

BACKGROUND OF THE INVENTION (1) Field of the Invention

The present invention relates to a duplex printing apparatus and a control method of the same apparatus suitable for performing electrophotographic printing on the obverse and reverse sides of continuous recording paper by a plurality of image forming sections and fixing sections provided within a single apparatus.

(2) Description of the Related Art

There is a conventional duplex printing apparatus that performs printing on both the obverse and reverse sides of a recording medium such as continuous recording paper (hereinafter referred to as a medium) by an electrophotographic method. Within the apparatus, the medium is conveyed. At a position opposite to one side of this medium, a first image forming process section for forming a toner image on the one side of the medium is disposed. At a position opposite to the other side of the medium and also downstream from the first image forming process section, a second image forming process section for forming a toner image on the other side of the medium is disposed. Furthermore, fixing sections for fixing the toner images formed on both sides of the medium are disposed. When the medium is being conveyed within the printing apparatus, printing is performed on both sides of the medium in sequence.

However, in such a conventional duplex printing apparatus, in making a switch-over from one printing mode to another printing mode for example, from a one-side printing mode for printing on only one side (e.g., obverse side) of a medium with the second image forming process section to another one-side printing mode for printing on only the other side (e.g., reverse side) of the medium with the first image forming process section, or to a double-side printing mode for printing on both the observe and reverse sides of the medium with the first and second image forming process sections, the last line position of the toner image, formed by the second image forming process section, is located at a position on the medium downstream from the printing start position of the first image forming process section, when one printing mode ends. For this reason, in this state, if printing is started in another printing mode and image formation is started by the first image processing unit, there is a problem that the portion of the medium between the first and second image forming process sections will become wasted.

Also, to exclude such a wasteful portion of the medium between the first and second image forming process sections, it is considered that the last end portion of the unfixed toner image, formed by the second image forming process section, is fed back to the printing start position of the first image forming process section in the opposite direction from the conveying direction for printing. In this case, when the last end position of the unfixed toner image on the medium, formed by the second image forming process section, is fed back to the printing start position of the first image forming process section, there is a problem that the unfixed toner image, formed on the medium between the second image forming process and the fixing section, will be disturbed by contact with the image forming drum of the second image forming process section and therefore the printing quality will be reduced.

SUMMARY OF THE INVENTION

The present invention has been made in view of the aforementioned problems. Accordingly, it is an object of the present invention to provide a duplex printing apparatus and a control method of the same apparatus which are capable of maintaining printing quality and printing a medium without waste, without disturbing the unfixed toner image formed on the medium when the medium is fed back in making a switch-over between printing modes.

To achieve the above object, the duplex printing apparatus of the present invention is a duplex printing apparatus for performing printing on both sides of a medium. The duplex printing apparatus comprises: a first image forming process unit for forming a toner image on the reverse of the medium; a second image forming process unit disposed at a position off the first image forming process unit for forming another toner image on the obverse of the medium; a fixing section disposed on a downstream of the first image forming process unit with respect to the medium conveying direction for fixing the toner images formed on the both side of the medium; a conveyance system for conveying the medium to the first image forming process unit, the second image forming process unit, and the fixing section; and a control section for controlling said apparatus so as to perform printing in a selective one of three printing modes which consist of an obverse printing mode in which printing of the second-named toner image is to be made by said second image forming process unit, a reverse printing mode in which printing of the first-named toner image is to be made on only the reverse of the medium by said first image forming process unit, and a double-side printing mode in which printing of the first and second-named toner images are to be made on both the reverse and obverse of the medium by the first and second image forming process units; wherein, in making a switch-over between the printing modes, the control section is operable to cause the fixing section to fix the unfixed toner image on the medium formed in the printing mode preceding before the switch-over and then conveys the medium by the conveyance system to a printing start position in the printing mode following after the switch-over.

Also, the control method of the duplex printing apparatus of the present invention is a control method of a duplex printing apparatus for performing printing on both sides of a medium. The apparatus comprises: a first image forming process unit for forming a toner image on the reverse of the medium; a second image forming process unit disposed at a position off the first image forming process unit for forming another toner image on the obverse side of the medium; a fixing section disposed on a downstream of the first image forming process unit with respect to the medium conveying direction for fixing the toner images formed on both sides of the medium; and a conveyance system for conveying the medium to the first image forming process unit, the second image forming process unit, and the fixing section one after another. The control method comprising the steps of: performing printing in a selective one of three printing modes which consists of an obverse printing mode for printing only on the obverse of the medium with the second image forming process unit, a reverse printing mode for printing only on the reverse of the medium with the first image forming process unit, and a double-side printing mode for printing on both sides of the medium with the first and second image forming process units; and when a switch-over is made between the printing modes, fixing by the fixing section the unfixed toner image on the medium formed in the printing mode preceding before the switch-over and then conveying the medium by the conveyance system to a printing start position in the printing mode following after the switch-over.

Therefore, according to the duplex printing apparatus of the present invention and the control method of the same apparatus, in making a switch-over between the printing modes, the control section fixes by the fixing section the unfixed toner image on the medium formed in the printing mode preceding before the switch-over and then conveys the medium by the conveyance system to a printing start position in the printing mode, following after the switch-over. Therefore, there is no occurrence of an unprinted wasteful portion in the medium, which is economical. Also, when the medium is conveyed to the printing start position in the printing mode following after the switch-over, the toner image formed on the medium has already been fixed. Therefore, even if this medium made contact with either the roller that rotates in the conveying direction of the medium for printing while contacting the unfixed toner image formed on the medium during printing, the first image forming process unit, the second image forming process unit or the like, there will be an advantage that can prevent disturbance of the toner image formed on the medium and a reduction in the printing quality of the medium.

Note that, in making a switch-over of the printing mode from either the obverse printing mode or the reverse printing mode to the double-side printing mode, the unfixed toner image on the obverse or reverse of the medium, formed by the second or first image forming process unit, may first be fixed by the fixing section and then the medium may be fed back to a printing start position in the first or second image forming process unit by the conveyance system.

With this, even if the medium made contact with either the roller that rotates in the conveying direction of the medium while for printing contacting the unfixed toner image formed on the medium during printing, the first image forming process unit, the second image forming process unit or the like, there is an advantage of preventing disturbance of the toner image formed on the medium and a reduction in the printing quality of the medium.

Also, in making a switch-over of the prpinting mode from the double-side printing mode either to the obverse printing mode or the reverse printing mode, the unfixed toner images on both sides of the medium, formed by the first and second image forming process units, may first be fixed by the fixing section and then the medium may be fed back to printing start positions in the first and second image forming process units by the conveyance system.

Similarly, with this arrangement, there is no occurrence of an unprinted wasteful portion in the medium, which is economical. In addition, even if this medium made contact with either the roller that rotates in the conveying direction of the medium for printing while contacting the unfixed toner image formed on the medium during printing, the first image forming process unit, the second image forming process unit or the like, there is no disturbance of the toner image formed on the medium and there is no reduction in the printing quality of the medium. Furthermore, in making a switch-over of the printing mode from the double-side printing mode either to the obverse printing mode or the reverse printing mode, even if, in either unused unit of the first or second transferring process units, the image forming drum and the medium are moved away from each other in the printing mode following after the switch-over by the moving mechanism, at this separation there is an advantage of preventing disturbance of the toner image formed on the medium and a reduction in the printing quality of the medium.

The duplex printing apparatus of the present invention may further comprises a moving mechanism for moving the medium and each of image forming drums in the first and second image forming process units toward and away from each other. Also, the moving mechanism may be controlled so that the medium is moved away from the image forming drum.

With this, by moving the medium from the image forming drum on the side of either unused unit of the first image forming process units or the second image forming process by the moving mechanism away, degradation due to the friction between the image forming drum and the medium can be prevented and the photosensitive drum can be prolonged in service life. Thus, there is an economical advantage.

Also, the conveyance system may be equipped with a blade-abutted roller including a roller which is rotatable in only one direction of the medium to convey while abutting the unfixed toner image formed on the medium during printing and a fixed blade abutting against a circumferential surface of the roller at a predetermined angle, and the blade-abutted roller is rotatable even when the medium is fed back.

With this even, wears on the blade-abutted roller in one direction due to friction with the medium can be prevented at the time of the back feed of the medium. In addition, since the toner attached to the roller surface can be evenly removed by the blade, there is an advantage that can prevent a reduction in the printing quality of the medium.

Furthermore, the conveyance system may be equipped with a back tension roller which is rotatable in a direction opposite to the conveying direction of the medium for printing while abutting the medium to apply tension to the medium during printing, the back tension roller is rotatable in the opposite direction when the medium is fed back.

With this, when the medium is conveyed in the conveying direction for printing, tension can be applied to the medium in the opposite direction and therefore the medium can be tensioned. Thus, there is an advantage that can convey the medium in the conveying direction for printing in a stable state and can enhance apparatus reliability.

In addition, when the medium is fed back, the blade-abutted roller is rotatable in the conveying direction for printing at a slower rotational speed than a rotational speed during direction. With this, since tension can be apply to the medium in a direction opposite to the conveying direction of the medium for printing to tension the medium when it is fed back, there is no wear on the blade-abutted roller in one direction when the medium is fed back. Since vibration and malfunction can be prevented during conveyance of the medium, apparatus reliability can be enhanced. In addition, since the toner attached to each roller surface can be evenly removed by the blade, there is no reduction in the printing quality of the medium. Furthermore, in these blade-abutted rollers, no excessive force acts between the blade and the roller, so apparatus reliability can be enhanced. Moreover, the toner attached to each surface of these rollers can be scraped even when the medium is fed back, there is an advantage that can prevent a reduction in the printing quality.

Furthermore, at the time of the back feed, the back tension roller is rotatable in a direction opposite to the conveying direction of the medium for printing at a faster rotational speed than a conveying speed of the medium. With this, tension can be apply to the medium in the direction opposite to the conveying direction of the medium for printing to tension the medium even when it is fed back, so there is an advantage that can feed back the medium in a stable state and enhance apparatus reliability.

Note that the conveyance system may have a roller which is rotatable in the conveying direction of the medium for printing while contacting the unfixed toner image formed on the medium during printing. The opposite side of the medium from the surface of the medium contacted by the roller being the obverse of the medium.

With this, there is no possibility that the toner image, formed on the obverse of the medium, will be disturbed and therefore high printing quality can be maintained in the printing of the obverse of the medium that is frequently performed as compared with the reverse of the medium. In addition, the height of the conveying path of the medium can be made low, so there is an advantage that can achieve the miniaturization of the apparatus.

BRIEF DESCRIPTION OF THE DRAWINGS

The above and other objects and advantages will become apparent from the following detailed description when read in conjunction with the accompanying drawings wherein:

FIGS. 3A to 3K are timing charts showing the state of each part in the case where the duplex printing apparatus makes a switch-over from the obverse printing mode to the double-side printing mode; and FIGS. 4A to 4K are timing charts showing the state of each part in the case where the duplex printing apparatus makes a switch-over from the double-side printing mode to the reverse printing mode.

DESCRIPTION OF THE PREFERRED EMBODIMENTS

A duplex printing apparatus and a control method of the same apparatus as an embodiment of the present invention will hereinafter be described with reference to the drawings. The duplex printing apparatus is connected to a higher apparatus such as a host computer and the like. In accordance with the printing request from this upper apparatus, the duplex printing apparatus conveys a recording medium (hereinafter referred to as a medium), such as continuous recording paper, which is an object to be printed, and performs printing on both sides of the medium by an electrophotographic method.

Figure 1:
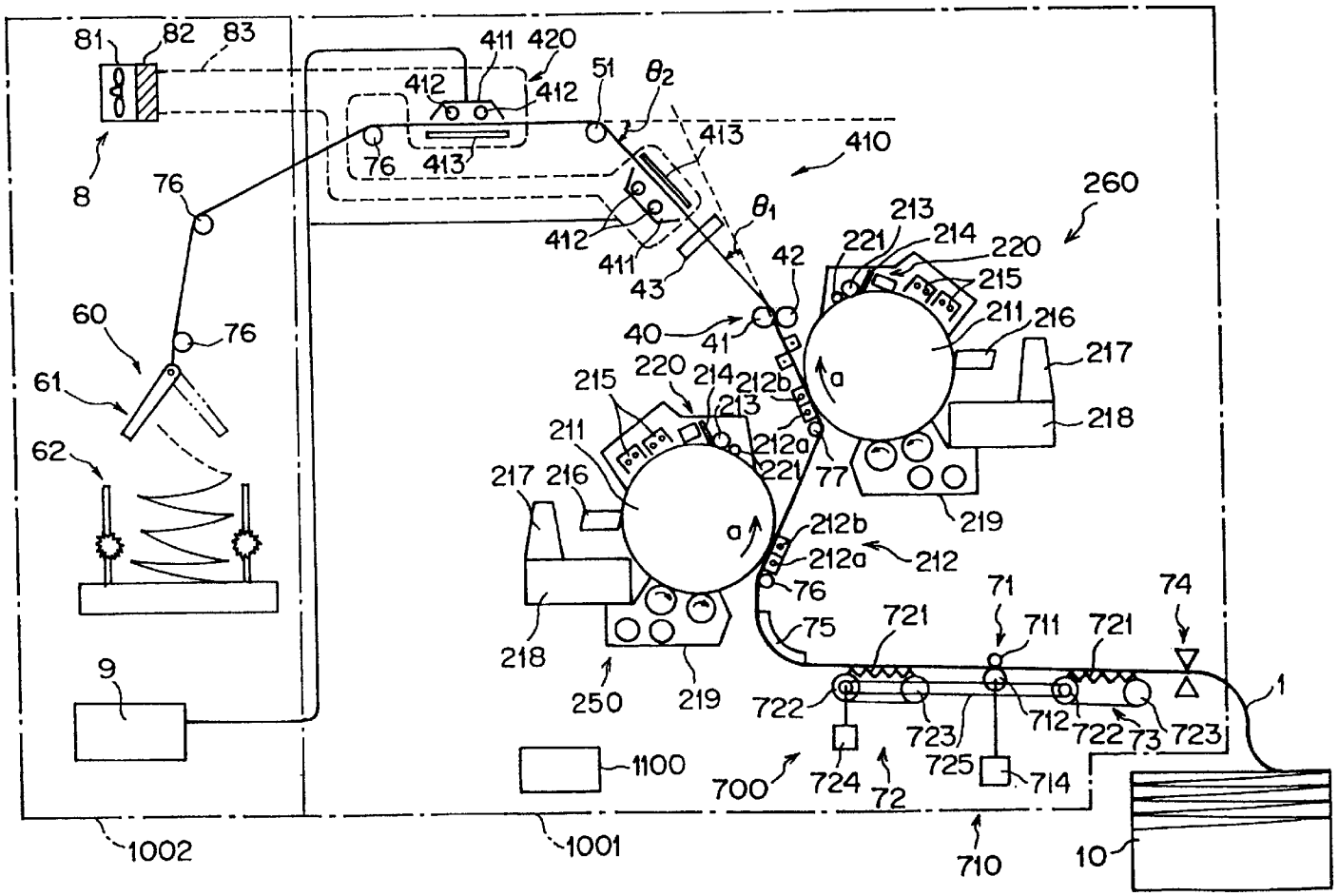
FIG. 1 is a schematic side view showing the constitution of a duplex printing apparatus as an embodiment of the present invention.

FIG. 1 is a schematic side view showing the constitution of the duplex printing apparatus. The duplex printing apparatus, as shown in the FIG. 1, is constituted by a paper hopper 10, a conveyance system 700, a first transferring process unit (first image forming process unit) 250, a second transferring process unit (second image forming process unit) 260, a first fixing section (fixing section) 410, a second fixing section (fixing section) 420, a stacker 60, a blower 8, a control section 1100, and a flash-fixer power source 9.

The paper hopper 10 holds an unprinted medium 1 in a stacked state and serially supplies the medium 1 to the duplex printing apparatus. The operator puts the unprinted medium 1 into this paper hopper 10 before start of printing.

The medium 1 is continuous recording paper, which is formed with perforations at predetermined-length intervals. In the lateral opposite portions, feed holes are formed at regular intervals.

The first transferring process unit 250 transfers a toner image to the reverse side of the medium 1 under the control of the control section 1100 by the electrophotographic method. The first transferring process unit 250 is constituted by a photosensitive drum (image forming drum) 211, an exposure light-emitting diode (LED) 216, pre-chargers 215, a cleaning section 220, a toner-hopper-attached developing unit 219, etc.

During printing, the photosensitive drum 211 rotates in a direction indicated by an arrow a in FIG. 1, while abutting the medium 1. A toner image is formed on the circumferential surface of the photosensitive drum 211. With the formed toner image in contact with the medium 1, the photosensitive drum 211 rotates in accordance with the direction of conveying the medium 1, thereby transferring the toner image to the medium 1.

At the exterior circumferential portion of the photosensitive drum 211 and above the photosensitive drum 211, a cleaning section 220 is disposed which is a cleaner unit for collecting the exhaust toner (residual toner) on the surface of the photosensitive drum 211. The cleaning section 220, as shown in FIG. 1, is constituted by a constant-pressure blade 214, a cleaning brush 213, and an exhaust toner screw 221.

The constant-pressure blade 214 abuts the circumferential surface of the photosensitive drum 211 across the lateral opposite ends of the photosensitive drum 211 at a predetermined angle. If the photosensitive drum 211 rotates in one direction (direction of arrow a in FIG. 1) in contact with the constant-pressure blade 214, at the contacted portion the residual toner attached to the surface of the photosensitive drum 211 is separated from the circumferential surface of the photosensitive drum 211.

At a position on the circumferential surface of the photosensitive drum 211, upstream from the constant-pressure blade 214, the cleaning brush 213 is disposed across the opposite ends of the photosensitive drum 211 so that it abuts the photosensitive drum 211. The cleaning brush 213 rotates in the direction opposite to the direction of arrow a, while abutting the circumferential surface of the photosensitive drum 211. With this rotation, the residual toner, separated from the photosensitive drum 211 by the constant-pressure blade 214, is moved to the exhaust toner screw 221.

At a position on the exterior circumferential portion of the photosensitive drum 211 upstream from the cleaning brush 213, a scraping plate (not shown) is rigidly provided across the lateral opposite ends of the photosensitive drum 211 so that it sticks into the cleaning brush 213. Also, at a position under the scraping plate, the exhaust toner screw 221 is disposed in parallel to the photosensitive drum 211. This exhaust toner screw 221 is rotated in a predetermined direction by a drive motor or a screw drive source (not shown).

In addition, at one end portion of the exhaust toner screw 221 and at a position under the downstream end portion of the photosensitive drum 211 when the exhaust toner screw 221 is rotated, a spent toner cartridge (not shown) is disposed as an exhaust toner collector. The exhaust toner, conveyed by rotation of the exhaust toner screw 221, falls and is collected into the exhaust toner collector.

Note that since this cleaning section 220 is enclosed with a cover (not shown), there is no possibility that the residual toner separated by the constant pressure blade 214 will fall on the photosensitive drum 211 during the time until it is collected by the exhaust toner collector.

More specifically, the residual toner on the surface of the photosensitive drum 211 is moved by the cleaning brush 213, after it has been separated from the surface of the photosensitive drum 211 by the constant-pressure blade 214. The exhaust toner moved by the cleaning brush 213 is dropped on the exhaust toner screw 221 by the scraping plate.

And the exhaust toner is conveyed by rotation of the exhaust toner screw 221 and falls at one end portion of the exhaust toner screw 221. The toner is collected in the exhaust toner collector disposed at the position under the one end portion of the exhaust toner screw 221.

At downstream positions of the cleaning section 220 along the exterior circumferential portion of the photosensitive drum 211, a plurality (in this embodiment, two pre-chargers) of pre-chargers 215 are disposed. The surface of the photosensitive drum 211 is evenly charged with electricity by these pre-chargers 215.

At a position downstream from the pre-chargers 215 along the exterior circumferential portion of the photosensitive drum 211, the exposure LED 216 is disposed. This exposure LED 216 consists of an LED head, etc. and is an optical exposure unit for projecting an optical image corresponding to an image to be printed onto the surface of the photosensitive drum 211 to form an electrostatic latent image.

At a position downstream from the exposure LED 216 along the exterior circumferential portion of the photosensitive drum 211, the toner-hopper-attached developing unit 219, which develops the electrostatic latent image formed by the exposure LED 216 to form an toner image, is disposed. A toner hopper 218 for supplying toner for development is attached to the toner-hopper-attached developing unit 219, and a toner cartridge 217 containing toner for development is detachably attached to the toner hopper 218.

The toner-hopper-attached developing unit 219 is equipped with a developer counter (not shown). This developer counter counts up, each time printing is performed.

The result counted by the developer counter is sent to the control section 1100.

At a position on the exterior circumferential portion of the photosensitive drum 211 downstream from the toner-hopper-attached developing unit 219, the photosensitive drum 211 makes contact with the medium 1.

At the opposite position of the medium 1 from the contacted position between the photosensitive drum 211 and the medium 1, a transfer section 212, which consists of a transfer charger 212*a* and a separation charger 212*b*, is disposed.

At the contacted position between the photosensitive drum 211 and the medium 1, the transfer charger 212*a* generates corona discharge with the potential of the opposite polarity from the charged potential of the toner image at the reverse side of the medium 1, thereby charging the medium 1 with electricity. With this, the toner image is attached and transferred to the medium 1. Also, at a downstream side on the conveying path of the medium 1, adjacent to the transfer charger 212*a*, the separation charger 212*b* is disposed for removing the charged electricity of the medium 1 so that the medium 1 can easily be separated from the photosensitive drum 211.

For the photosensitive drum 211 that has transferred the toner image formed on the surface to the reverse of the medium 1, the residual toner on the surface is removed at the cleaning section 220 again.

Figure 2A:
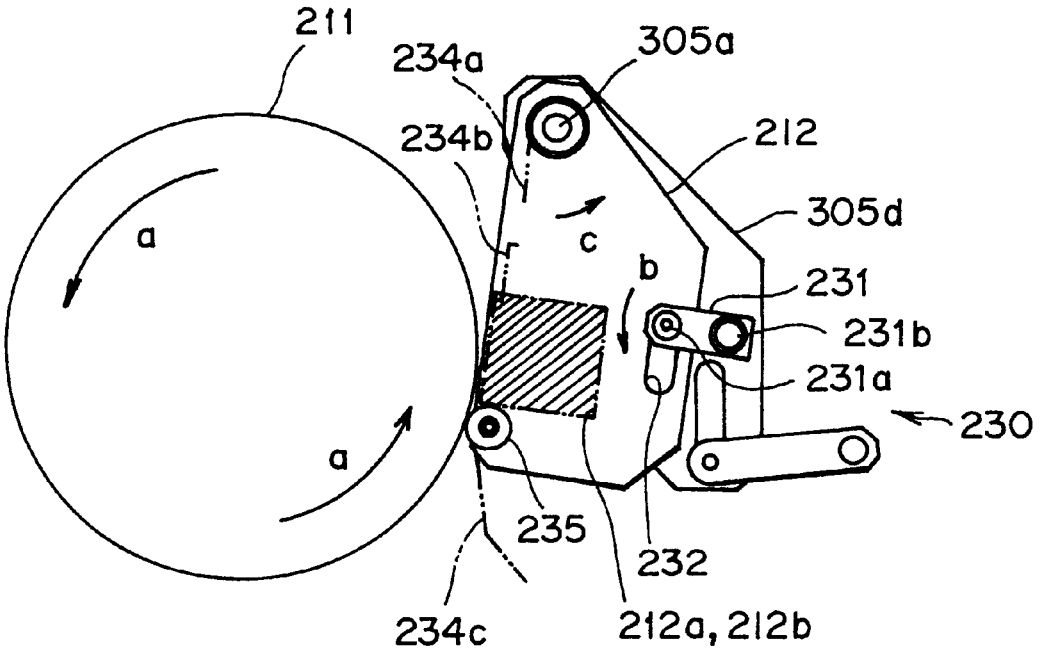
FIGS. 2A and 2B are schematic side views showing the constitution of the moving mechanism in the duplex printing, the state of transfer being shown in FIG. 2A and the state of separation being shown in FIG. 2B.
Figure 2B:
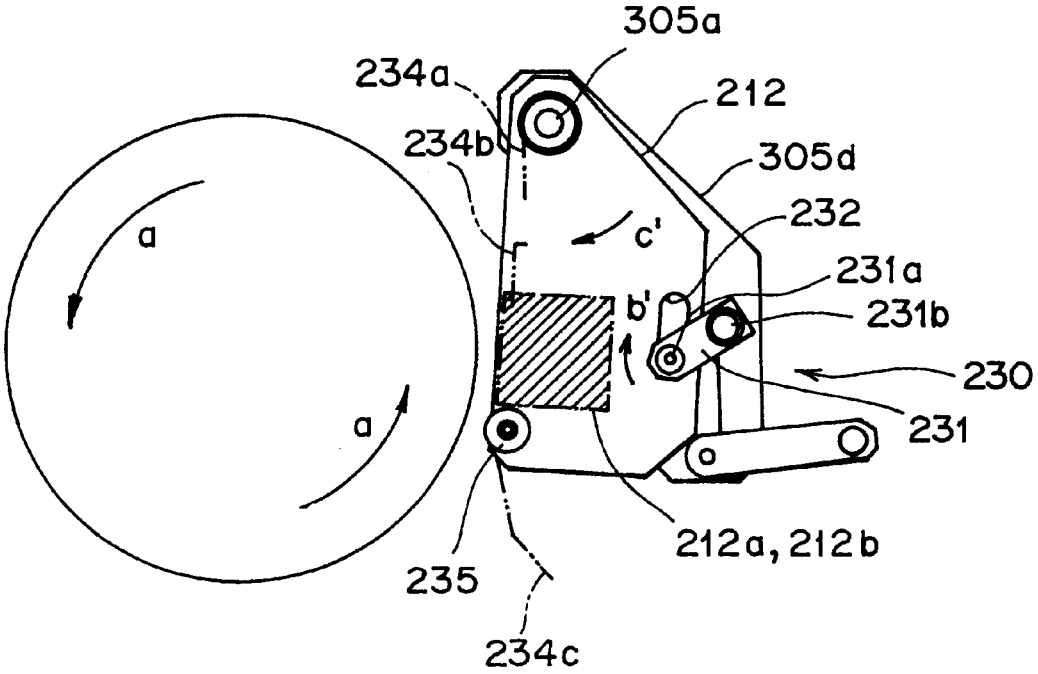

In accordance with control by the control section 1100, the transfer section 212 and the medium 1 are moved toward and away from the photosensitive drum (image forming drum) 211 in the first transferring process unit 250 by a moving mechanism 230 shown in FIGS. 2A and 2B.

FIGS. 2A and 2B each show the constitution of the moving mechanism in the duplex printing apparatus as an embodiment of the present invention. FIG. 2A is a schematic side view showing the state of the transfer, while FIG. 2B is a schematic side view showing the state of the separation.

As shown in FIGS. 2A and 2B, the moving mechanism 230 for moving the medium 1 and the photosensitive drum (image forming drum) 211 in the first transferring process unit 250 toward and away form each other is constituted by a slide groove 232 formed in the side portion of the transfer section 212 in parallel with the arrangement of the transfer and separation chargers 212*a* and 212*b*, a moving arm 231, and a stepping motor (not shown) for rotating the moving arm 231.

The transfer section 212 is supported by a transfer section rotating fulcrum shaft 305*a* so that it is free to rotate with respect to a jam processing side plate 305*d*. At the time of the transfer of the toner image to the medium 1, the transfer section 212 is moved close to the surface of the photosensitive drum 211 through the medium 1.

In addition, a portion of the transfer section 121, opposite from the photosensitive drum 211, is provided with guides 234*a*~234*c* and a guide roller 235 for guiding the medium 1.

One end portion of the moving arm 231 is formed with a slide shaft 231*a*, which is fitted into a slide groove 232 so that it is slidably guided. Also, the other end portion of the moving arm 231 is supported by a moving-arm rotating fulcrum 231*b* so that it is free to rotate with respect to the jam processing side plate 305*d*. Furthermore, a stepping motor (not shown) is connected to the moving arm 231. This stepping motor rotates the moving arm 231 on the moving-arm rotating fulcrum 231*b*, while it is being operated and controlled by the control section 1100.

If the moving arm 231 is rotated in the direction of arrow b in FIG. 2A by the stepping motor, the slide shaft 231*a* of the moving arm 231 moves while being guided by the slide groove 232. In accordance with the movement of the slide shaft 231*a* along the slide groove 232, the transfer section 212 rotates on the transfer section rotating fulcrum shaft 305*a* in the direction of arrow c in FIG. 2A. As a result, as shown in FIG. 2B, the transfer section 212 is moved away from the photosensitive drum 211 along with the medium 1.

Conversely, if the moving arm 231 is rotated in the direction of arrow b' in FIG. 2B by the stepping motor, the slide shaft 231*a* of the moving arm 231 moves while being guided by the slide groove 232. In accordance with the movement of the slide shaft 231*a* along the slide groove 232, the transfer section 212 rotates on the transfer section rotating fulcrum shaft 305*a* in the direction of arrow c' in FIG. 2B. As a result, as shown in FIG. 2A, the transfer section 212 is moved close to the photosensitive drum 211 along with the medium 1.

The second transferring process unit 260 is disposed above the first transferring process unit 250 so that it abuts the obverse side of the medium 1, and forms a toner image on the obverse side of the medium 1. The second transferring process unit 260 has constitution common to the first transferring process unit 250, and they are symmetrically disposed about a vertical plane across the medium 1.

Note that in the second transferring process unit 260 shown in FIG. 1, the same reference numerals will be applied to the same parts as the aforementioned first transferring process unit 250 and nearly to the same parts for omitting a description thereof. Also, the second transferring process unit 260 is provided with a moving mechanism 230 of the same constitution as that described in FIGS. 2A and 2B.

The first fixing section 410 and the second fixing section 420 both flash-fix the toner image formed on the medium 1. Each fixing section is constituted by flash lamps 412, which consist of a xenon lamp or the like, a reflecting mirror 411, and a counter reflecting mirror 413. The first fixing section 410 and the second fixing section 420 have constitution common to each other.

More specifically, the flash lamps 412 are disposed on the side of the medium 1 to which the unfixed toner image is fixed. Also, the reflecting mirror 411 is disposed behind the flash lamps 412 so that the flashed light from the flash lamps 412 is reflected to the fixing side of the medium 1. The counter reflecting plate 413 is disposed at the opposite position from the flash lamps 412 and the reflecting mirror 411 across the medium 1 so that the flashed light from the flash lamp 412 is efficiently emitted to the medium 1.

The first fixing section 410 is disposed on a downstream side from the first transferring process unit 250 so that the toner image formed on the reverse side of the medium 1 is fixed by the first transferring process unit 250. Also, the second fixing section 420 is disposed on a downstream side from the first transferring process unit 260 so that the toner image formed on the obverse of the medium 1 is fixed by the second transferring process unit 260. Note that in this embodiment, the second fixing section 420 is disposed on a downstream side from the first fixing section 410.

The first fixing section 410 and the second fixing section 420 are enclosed with a duct 83. This duct 83 is connected to the blower 8 so that smoke and an offensive smell, produced in the first and second fixing sections 410 and 420 and consisting of organic high molecular compounds such as styrene, butadiene, phenol and the like, are collected.

The blower 8 is provided with a fan 81 and a filter 82 consisting of active carbon and the like. The fan 81 discharges air within the duct 83. With this, the smoke and the like collected by the duct 83 are passed through the filter 82. After the offensive smell contained in the smoke has been adsorbed, the smoke and the like are discharged outside this apparatus.

The flash-fixer power source 9 supplies electric power to the flash lamps 412 of the first and second fixing sections 410 and 420.

Note that in this apparatus, a main power source unit(not shown) is provided within a first case 1001. This main power source unit supplies electric power to the first transferring process unit 250, the second transferring process unit 260, the conveyance system 700, etc.

Between the paper hopper 10 and the stacker 60, the conveyance system 700 conveys the medium 1 in the order of first transferring process unit 250, second transferring process unit 260, first fixing section 410, and second fixing section 420. This conveyance system 700 is constituted by a conveyor tractor 710, a guide portion 75, guide rollers 76, a transfer guide roller 77, a first turn roller pair 40, and a second turn roller 51.

The conveyor tractor 710 is a conveyor unit for conveying the medium 1 and constituted by a plurality (in this embodiment, two mechanisms) of tractor mechanisms 72 and 73. These tractor mechanisms 72 and 73 have constitution common to each other. Each tractor mechanism 72 and 73 is constructed so that an endless tractor belt 721 with feed pins at regular intervals is looped between a driving shaft 722 and a driven shaft 723 disposed in parallel with each other.

Also, between the driving shaft 722 of the tractor mechanism 72 and the driving shaft 722 of the tractor mechanism 73, a driving belt 725 is looped. Furthermore, the driving shaft 722 of the tractor mechanism 72 is connected to a driving motor 724.

The driving motor 724 is able to rotate the driving shaft 722 at arbitrary speeds in arbitrary directions. If the driving shaft 722 is rotated by the driving motor 724, the driving shaft 722 of the tractor mechanism 72 and the driving shaft 722 of the tractor mechanism 73 are rotated in the same direction in synchronization with each other. Thus, the tractor mechanisms 72 and 73 can convey the medium 1 in both the conveying direction for printing and the opposite direction from the conveying direction.

In conveying the medium 1 in the opposite direction from the conveying direction for printing, the conveyor tractor 710 can convey the medium 1 at a speed higher than the conveying speed for printing.

Also, between the tractor mechanisms 73 and 72, i.e., on an upstream side from the tractor mechanism 72 disposed on the most upstream side, the conveyor tractor 710 is provided with a back tension roller 71 for producing tension in the opposite direction from the conveying direction of the medium 1 for printing.

The back tension roller 71 is constituted by a pair of pressure rollers consisting of a driving-side pressure roller 712 and a driven-side pressure roller 711.

The driving-side pressure roller 712 is connected to a driving motor 714. The driving motor 714 rotates the driving-side pressure roller 712 at arbitrary speeds in the conveying direction of the medium 1 for printing and the opposite direction from the conveying direction.

More specifically, in conveying the medium 1 in the conveying direction for printing, the driving motor 714 rotates the driving-side pressure roller 712 in the conveying direction of the medium 1 for printing so that the circumferential speed of the roller 712 becomes slower than the conveying speed of the medium 1 for printing.

Also, in conveying the medium 1 in the opposite direction from the conveying direction for printing, i.e., in feeding the medium 1 back, the driving motor 714 rotates the driving-side pressure roller 712 in the opposite direction from the conveying direction of the medium 1 for printing so that the circumferential speed of the roller 712 becomes faster than the conveying speed of the medium 1. With this, in feeding the medium 1 back, the back tension roller 71 rotates, for example, in the opposite direction from the conveying direction for printing at a rotational speed about 1~10% faster than the speed of conveying the medium 1.

The driven-side pressure roller 711 presses the obverse of the medium 1 against the driving-side pressure roller 712 and rotates in accordance with conveyance of the medium 1.

That is, the back tension roller 71 gives tension to the medium 1 in the opposite direction from the conveying direction of the medium 1 for printing, by rotating the driving-side pressure roller 712 in the opposite direction by the driving motor 714 with the medium 1 held between the driving-side pressure roller 712 and the driven-side pressure roller 711. Also, in feeding the medium 1 back, the back tension roller 711 gives tension to the medium 1 in the opposite direction from the conveying direction of the medium 1 for printing, by rotating the driving-side pressure roller 712 in the opposite direction at a rotational speed faster than the conveying speed of the medium 1. With this, the back tension roller 71 can tension the medium 1 even when it is fed back.

The first turn roller pair 40 is disposed between the second transferring process unit 260 and the first fixing section 410 and is constituted by first turn rollers (blade-abutted roller) 41 and 42, which are both disposed so as to abut the medium 1 at opposite positions across the medium 1. The first turn roller 41 is disposed so as to abut the reverse side of the medium 1, while the first turn roller 42 is disposed so as to abut the obverse side of the medium 1.

These first turn rollers 41 and 42 are respectively connected to drive motors (not shown). The first turn rollers 41 and 42 are respectively rotated at arbitrary speeds by the drive motors.

Note that each length of the first turn rollers 41 and 42 in the widthwide direction of the medium 1 is longer than that of each photosensitive drum 211 in the first and second transferring process units 250 and 260 and that of the second fixing section 420.

Also, the first turn rollers 41 and 42 both have a low light transmission coefficient. Each surface portion is constituted by a member with a low light reflection coefficient, for example, fluorocarbon resin, such as PFA, coated on a black-painted aluminum roller. The surface is charged with electricity to the same polarity as toner.

Furthermore, the medium 1 is wound by a predetermined angle around the first turn roller 41 of the first turn rollers 41 and 42 constituting the first turn roller pair 40. The angle between the conveying path of the medium 1 in the second transferring process unit 260 and the conveying path of the medium 1 in the first fixing section 410 is a predetermined angle $\theta_1$ or more (e.g., $\theta_1 \geqq 30°$ is preferable). The first turn roller 42 functions as a turn portion for changing the conveying direction of the medium 1 between the second transferring process unit 260 and the first fixing section 410.

The first turn roller pair 40, disposed between the second transferring process unit 260 and the first fixing section 410, also functions as a light shielding member for preventing the leakage light from the first and second fixing sections 410 and 420 from reaching the first and second transferring process units 250 and 260.

Since the turn portion is constituted by the first turn roller pair 40 consisting of first turn rollers 41 and 42, it can be realized with simple construction. The turn portion is also able to convey the medium 1 without disturbing the unfixed toner image formed on the medium 1.

Also, since the first turn rollers 41 and 42 of the first turn roller pair 40 can prevent the leakage light from the first and second fixing sections 410 and 420 from being emitted to each photosensitive drum 211 of the first and second transferring process units 250 and 260, a reduction in the service life of each photosensitive drum 211 due to light degradation can be prevented and a reduction in printing quality due to a reduction in the surface potential of the photosensitive drum 211 can be prevented.

In addition, each length of the first turn rollers 41 and 42 of the first turn roller pair 40 in the widthwide direction of the medium 1 is longer than that of each photosensitive drum 211 in the first and second transferring process units 250 and 260 and that of the second fixing section 420, so a non-passed medium portion of the medium 1 can prevent the leakage light from the first and second fixing sections 410 and 420 from being emitted to each photosensitive drum 211 of the first and second transferring process units 250 and 260. Also, a reduction in the service life of each photosensitive drum 211 due to light degradation can be prevented and a reduction in printing quality due to a reduction in the surface potential of the photosensitive drum 211 can be prevented.

Furthermore, since the first turn rollers 41 and 42 are constituted by fluorocarbon resin, such as PFA, coated on a black-painted aluminum roller, the light transmission coefficient is low and therefore light of shielding can be reliably performed. Since each surface portion has a low light reflection coefficient, the emission of each leakage light from the first and second fixing sections 410 and 420 to each photosensitive drum 211 of the first and second transferring process units 250 and 260 due to the irregular reflection at that surface portion can be prevented. Since the first turn rollers 41 and 42 are coated with fluorocarbon resin such as PFA, toner can easily be separated. Since the surface is charged with electricity to the same polarity as toner, the attachment of toner to the surface is difficult and it is difficult for the surface to disturb a toner image.

In addition, the angle between the conveying path of the medium 1 in the second transferring process unit 260 and the conveying path of the medium 1 in the first fixing section 410 is constructed so as to be a predetermined angle $\theta_1$ or more ($\theta_1 \geqq 30°$ is preferable) by the first turn roller pair 40, so this arrangement also prevents the leakage light from the first fixing section 410 from reaching the first and second transferring process units 250 and 260.

Moreover, since the first turn roller pair 40 functions as a light shielding member for preventing the leakage light from the first and second fixing sections 410 and 420 from reaching the first and second transferring process units 250 and 260, there is no need to provide a light shielding member and therefore the number of components constituting the apparatus can be reduced.

The second turn roller 51 is disposed between the first and second fixing sections 410 and 420 so that it abuts the side of the medium 1 to which a toner image is fixed by the first fixing section 410 (in this embodiment, the reverse side). The second turn roller 51 is a conveying-direction changing roller that rotates in accordance with conveyance of the medium 1, while abutting the medium 1.

Also, the second turn roller 51 is constructed so that the medium 1 is wound on the roller 51 by a predetermined angle, and functions as a conveying-direction changing section that changes the conveying direction of the medium 1 and sends out the medium 1 to the second fixing portion 420, while abutting one side of the medium 1 between the first and second fixing portions 410 and 420.

Note that the length of the second turn roller 51 in the widthwise direction of the medium 1 is constructed so as to be longer than that of each photosensitive drum 211 in the first and second transferring process units 250 and 260 and that of the second fixing section 420. Also, this second turn roller 51 has a low light transmission coefficient. The surface portion is formed with a member having a low light reflection coefficient.

Wounding the medium 1 on this second turn roller 51 by a predetermined angle, the frictional force, produced between the reverse side of the medium 1 and the roller surface of the second turn roller 51, can act as reaction force on the medium 1 when it is conveyed by the conveyor tractor 710. Thus, the second turn roller 51 is always able to tension the medium 1 during conveyance.

Note that in this embodiment, while the second turn roller 51 abuts the reverse side of the medium 1, there is no possibility that the second turn roller 51 will disturb the toner image and reduce the printing quality of the medium 1, because the toner image on the reverse side of the medium 1 at this second turn roller 51 has already been fixed by the first fixing section 410.

Also, since the second turn roller 51 changes the conveying direction of the medium 1 and makes the conveying direction of the medium 1 in the second fixing section 420 approximately horizontal, the second fixing section 420 can be disposed at a lower position. Therefore, the height of the conveying path of the medium 1 can made low and miniaturization of the apparatus can be realized.

Furthermore, since the second turn roller 51 changes the conveying direction of the medium 1, there is no possibility that at the second fixing section 420, the leakage light from a non-passed medium portion of the medium 1 will reach each photosensitive drum 211 of the first and second transferring process units 250 and 260. Moreover, the second turn roller 51 prevents the leakage light from the second fixing section 420 from propagating along the obverse side of the medium 1 and reaching the second transferring process unit 260, thereby shielding the leakage light from the entire second fixing section 420. In this manner, this second turn roller 51 functions as a light shielding member.

That is, since the second turn roller 51 can prevent the leakage light from the second fixing section 420 from being emitted to the photosensitive drum 211 of the second transferring process unit 260, a reduction in the service life of the photosensitive drum 211 due to light degradation of the photosensitive drum 211 can be prevented and a reduction in printing quality due to a reduction in the surface potential of the photosensitive drum 211 can be prevented.

In addition, the dimension of the second turn roller 51 in the widthwise direction of the medium 1 is longer than that of each photosensitive drum 211 of the first and second transferring process units 250 and 260 and that of the second fixing section 420, so a non-passed medium portion of the medium 1 can prevent the leakage light from the second fixing section 420 from being emitted to each photosensitive drum 211 of the first and second transferring process units 250 and 260. Also, a reduction in the service life of each photosensitive drum 211 due to light degradation of the photosensitive drum 211 can be prevented and a reduction in printing quality due to a reduction in the surface potential of the photosensitive drum 211 can be prevented.

Furthermore, since the second turn roller 51 is constituted by a member with a low light transmission coefficient, light shielding can be reliably performed. Moreover, since the surface portion is formed with a member having a light reflection coefficient, the arrival of leakage light onto each photosensitive drum 211 of the first and second transferring process units 250 and 260 due to the irregular reflection at that surface portion can be prevented.

Moreover, the second turn roller 51 shields the light leaked from the second fixing section 420, so it is also used as a light shielding roller serving as a light shielding member for shielding the leakage light from the second fixing section 420 to prevent this leakage light from reaching the second transferring process unit 260. For this reason, the number of components constituting the apparatus can be reduced and therefore the manufacturing cost can be reduced.

Also, the angle between the conveying path of the medium 1 in the first fixing section 410 and the conveying path of the medium 1 in the second fixing section 420 is constructed so as to be a predetermined angle $\theta_2$ or more (e.g., $\theta_2 \geqq 10°$ is preferable) by the conveying system 700, particularly the first turn roller pair 40 and the second turn roller 51.

Between the second transferring process unit 260 and the first fixing section 410, a light shielding portion 43 for shielding the leakage light from the first fixing section 410 is disposed.

Guide rollers 76 are disposed at a plurality of places along the conveying path of the medium 1 within the apparatus, and guide the medium 1 so that the medium 1 passes along a predetermined path, along with the guide portion 75 which is a curved plate member.

These guide rollers 76 guide the medium 1 so that the medium 1 passes into between the photosensitive drum 211 and the transfer section 212 at the first transferring process unit 250, and also guide the medium 1 passed through the second fixing section 420 to the stacker 60.

Wounding the medium 1 on each of the guide rollers 76 by a predetermined angle, the frictional force, produced between the reverse side of the medium 1 and the roller surface of each guide roller 76, can act as reaction force on the medium 1 when it is conveyed by the conveyor tractor 710. Thus, the guide rollers 76 are always able to tension the medium 1 during conveyance.

A transfer guide roller 77 is disposed on an upstream side on the conveying path of the medium 1 from the transfer section 212 of the second transferring process unit 260 and also on the reverse side of the medium 1. The transfer guide roller 77 abuts the reverse side of the medium 1 and guides this medium 1 to the second transferring process unit 260.

This transfer guide roller 77 is connected to a drive motor (not shown) so that it is rotated at arbitrary speeds. Also, the surface of the transfer guide roller 77 is formed with a film of fluorocarbon resin, etc. With this film, the transfer guide roller 77 is prevented from being worn away due to the friction between it and the medium 1. Also, the attachment of the unfixed toner on the reverse side of the medium 1 to the transfer guide roller 77 is suppressed.

The first turn rollers 41 and 42 and the transfer guide roller 77 are respectively charged with electricity to the same polarity as the unfixed toner on the medium 1. For this reason, when the first turn rollers 41 and 42 and the transfer guide roller 77 abut the unfixed toner on the medium 1, there is no possibility that the unfixed toner on the medium 1 will adhere to the first turn rollers 41 and 42 and the transfer guide roller 77 and there is no possibility that the toner image formed on the medium 1 will be disturbed.

Furthermore, the first turn rollers 41 and 42 and the transfer guide roller 77 are provided with cleaning blades, respectively. The cleaning blade abuts the roller at a predetermined angle. If the first turn rollers 41 and 42 and the transfer guide roller 77 are rotated in the conveying direction for printing, the toner attached to these surfaces will be scraped off.

The first turn rollers 41 and 42 and the transfer guide roller 77 are constructed so that they rotate only in the conveying direction for printing. Also, the first turn rollers 41 and 42 and the transfer guide roller 77 are rotated and controlled by the control section 1100, respectively.

In addition, the components in this apparatus, i.e., the paper hopper 10, the conveyance system 700, the first transferring process unit 250, the second transferring process unit 260, the first fixing section 410, the second fixing section 420, the stacker 60, the blower 8, the flash-fixer power source 9, etc. are operated and controlled by the control section 1100.

The control section 1100 compares the count value sent from each of the toner-hopper-attached developing units 219 of the first and second transferring process units 250 and 260 with a previously recorded predetermined value. When the count value is greater than the predetermined value, the control section 1100 informs the operator that the filter 82 should be exchanged, by display means (not shown), such as lighting an alarm lamp (not shown). If the filter 82 is exchanged by the operator, the control section 1100 resets the value of each developer counter to zero.

Also, the control section 1100 in this embodiment has the function of controlling that apparatus so as to switch-over any one of printing modes; an obverse printing mode of performing printing only on the obverse side of the medium 1 with the second transferring process unit 260, the second fixing section 420, and the conveyance system 700, a reverse printing mode of performing printing only on the reverse side of the medium 1 with the first transferring process unit 250, the first fixing section 410, and the conveyance system 700, and a double-side printing mode of performing printing on both the obverse and reverse sides of the medium 1 with the first transferring process unit 250, the first fixing section 410, the second transferring process unit 260, the second fixing section 420, and the conveyance system 700.

Furthermore, in making a switch-over between printing modes, the control section 1100 fixes by the first fixing section 410 or the second fixing section 420 the unfixed toner image on the medium 1 formed in the printing mode preceding before the switch-over and then conveys the medium 1 by the conveyance system 700 to a printing start position in the printing mode following after the switch-over.

That is, in making a switch-over from the obverse printing mode to the reverse printing mode, the control section 1100 conveys the medium 1 by the conveyance system 700 and fixes by the second fixing section 420 the unfixed toner image on the obverse side of the medium 1 formed by the second transferring process unit 260 in the obverse printing mode. Next, the control section 1100 feeds back the medium 1 by the conveyance system 700 to convey the rearmost end position of the printed data fixed on the obverse side of the medium 1 to a position (printing start position) between the photosensitive drum 211 and the transfer charger 212*a* in the first transferring process unit 250. Furthermore, the control section 1100 moves the transfer section 212 and the medium 1 away from the photosensitive drum 211 by the moving mechanism 230 in the second transferring process unit 260 and also moves the transfer section 212 and the medium 1 in the first transferring process 250 close to the photosensitive drum 211 by the moving mechanism 230 in the first transferring process unit 250.

Similarly, in making a switch-over from the reverse printing mode to the obverse printing mode, the control section 1100 conveys the medium 1 by the conveyance system 700 and fixes by the first fixing section 410 the unfixed toner image on the reverse side of the medium 1 formed by the first transferring process unit 250 in the reverse printing mode. Next, the control section 1100 feeds back the medium 1 by the conveyance system 700 to convey the rear end position of the printed data fixed on the reverse side of the medium 1 to a position (printing start position) between the photosensitive drum 211 and the transfer charger 212*a* in the second transferring process unit 260. Furthermore, the control section 1100 moves the transfer section 212 and the medium 1 away from the photosensitive drum 211 by the moving mechanism 230 in the first transferring process unit 250 and also moves the transfer section 212 and the medium 1 in the second transferring process 260 close to the photosensitive drum 211 by the moving mechanism 230 in the second transferring process unit 260.

Also, in making a switch-over from the obverse printing mode to the double-side printing mode, the control section 1100 conveys the medium 1 by the conveyance system 700 and fixes by the second fixing section 420 the unfixed toner image on the obverse side of the medium 1 formed by the second transferring process unit 260 in the obverse printing mode. Next, the control section 1100 feeds back the medium 1 by the conveyance system 700 to convey the rear end position of the printed data fixed on the obverse side of the medium 1 to the position (printing start position) between the photosensitive drum 211 and the transfer charger 212*a* in the first transferring process unit 250. Furthermore, the control section 1100 moves the transfer section 212 and the medium 1 in the first transferring process 250 close to the photosensitive drum 211 by the moving mechanism 230 in the first transferring process unit 250.

Similarly, in making a switch-over from the reverse printing mode to the double-side printing mode, the control section 1100 conveys the medium 1 by the conveyance system 700 and fixes by the first fixing section 410 the unfixed toner image on the reverse side of the medium 1 formed by the first transferring process unit 250 in the reverse printing mode. Next, the control section 1100 feeds back the medium 1 by the conveyance system 700 to again convey the rear end position of the printed data fixed on the reverse side of the medium 1 to the position (printing start position) between the photosensitive drum 211 and the transfer charger 212*a* in the first transferring process unit 250. Furthermore, the control section 1100 moves the transfer section 212 and the medium 1 in the second transferring process 260 away from the photosensitive drum 211 by the moving mechanism 230.

Furthermore, in making a switch-over from the double-side printing mode to the obverse printing mode, the control section 1100 conveys the medium 1 by the conveyance system 700 and fixes by the first fixing section 410 the unfixed toner image on the reverse side of the medium 1 formed by the first transferring process unit 250 in the double-side printing mode. The control section 1100 also fixes by the second fixing section 420 the unfixed toner image on the obverse side of the medium 1 formed by the second transferring process unit 260 in the double-side printing mode. Next, the control section 1100 feeds back the medium 1 by the conveyance system 700 to convey the rear end position of the printed data fixed on the obverse side of the medium 1 to the position (printing start position) between the photosensitive drum 211 and the transfer charger 212*a* in the second transferring process unit 260. Furthermore, the control section 1100 moves the transfer section 212 and the medium 1 in the first transferring process 250 away from the photosensitive drum 211 by the moving mechanism 230.

Likewise, in making a switch-over from the double-side printing mode to the reverse printing mode, the control section 1100 conveys the medium 1 by the conveyance system 700 and fixes by the first fixing section 410 the unfixed toner image on the reverse side of the medium 1 formed by the first transferring process unit 250 in the double-side printing mode. The control section 1100 also fixes by the second fixing section 420 the unfixed toner image on the obverse side of the medium 1 formed by the second transferring process unit 260 in the double-side printing mode. Next, the control section 1100 feeds back the medium 1 by the conveyance system 700 to convey the rear end position of the printed data fixed on the obverse side of the medium 1 to the position (printing start position) between the photosensitive drum 211 and the transfer charger 212*a* in the first transferring process unit 250. Furthermore, the control section 1100 moves the transfer section 212 and the medium 1 in the second transferring process 260 away from the photosensitive drum 211 by the moving mechanism 230.

In the conveyance system 700, conveyor rollers (not shown) are disposed on a downstream side from the second fixing section 420 and an upstream side from the stacker 60. The conveyor rollers rotate in synchronization with the aforementioned conveyor tracker 710 while abutting the medium 1, thereby selectively switching the conveying direction of the medium 1 to either the conveying direction for printing or the opposite direction and conveying the medium 1.

The stacker 60 is a medium accumulating section for accumulating the medium 1 after printing and is constituted by a swing guide 61 and a stacker portion 62. The swing guide 61 guides the medium 1 conveyed by the guide rollers 76, while being swung. With this, the medium 1 is serially folded along its perforations and stacked in the stacker portion 62.

The above-mentioned first transferring process unit 250, the second transferring process unit 260, the first fixing section 410, the second fixing section 420, the conveyance system 700, and the control section 1100 are disposed within the first case 1001. Also, the blower 8, the stacker 60, and the flash-fixer power source 9 are disposed within a second case 1002.

That is, in the apparatus of the present invention, the stacker 60 is disposed downstream of the second fixing section 420 and within a conveying path length range in which data compensation is possible with the host computer that is a higher apparatus making a request of printing. Also, the conveying path of the medium 1 from the second fixing section 420 to the stacker 60 is short. Therefore, if a problem such as a jam of the medium 1 arises, the reprinting of the portion of the medium 1 in which the problem has arisen can be performed quickly by the host computer. As a result, the time required for recovery operation can be shortened and apparatus reliability can be enhanced.

In the conveyor tractor 710, a medium last end detection section 74 for detecting the last end portion of the medium 1 is attached at an upstream side from the tractor mechanism 73. This medium last end detection section 74 is constituted, for example, by an optical sensor consisting of a light-emitting element and a light-receiving element. The medium 1 is disposed so as to intercept the space between the light-emitting and light-receiving elements. When the medium 1 intercepting the space between the light-emitting and light-receiving elements has gone, light from the light-emitting element is detected by the light-receiving element and the operator is informed by a display section or the like (not shown) that the last end of the medium 1 has been detected.

When duplex printing is performed on the medium 1 in the double-side printing mode by the duplex printing apparatus in this embodiment constituted as described above, the operator first sets the medium 1 to the paper hopper 10 and then attaches the medium 1 to the feed pins of the tractor belt 721 of the tractor mechanism 73 by fitting the feed holes formed in lateral opposite portions of the medium 1 onto the feed pins.

Thereafter, with control from the host computer, print data is sent to this apparatus and duplex printing is started.

First, the medium 1 is conveyed by the conveyor system 700. In the first transferring process unit 250, the photosensitive drum 211 is driven by a drive unit (not shown) in synchronization with the conveyance of the medium 1 by the conveyor system 700, and rotates in the direction of arrow a.

In the first transferring process unit 250, the surface of the photosensitive drum 211 is evenly charged with electricity by the pre-chargers 215. Then, with the exposure LED 216, image exposure is performed in accordance with an image signal to be printed, in order to form a latent image on the surface of the photosensitive drum 211.

With the toner-hopper-attached developing unit 219, the latent image is developed to form a toner image corresponding to the print data on the surface of the photosensitive drum 211.

At the position where the photosensitive drum 211 abuts the medium 1 and at the opposite position from the photosensitive drum 211 across the medium 1, the transfer charger 212*a* charges the medium 1 with electricity to the polarity opposite from the polarity of toner forming the toner image. With this, the toner image on the photosensitive drum 211 is attracted to the medium 1 and transferred on the reverse side of the medium as the unfixed toner image. After this transfer, the charged electricity of the medium 1 is removed by the separation charger 212*b* so that the photosensitive drum 211 and the medium can easily be separated.

On the other hand, the photosensitive drum 211, from which the toner image was transferred to the reverse side of the medium 1, is again charged evenly with electricity by the pre-charger 215, after the residual toner on the surface has been removed in the cleaning section 220.

Next, the medium 1 is conveyed to the second transferring process unit 260 by the conveyance system 700. In this second transferring process unit 260, as with the first transferring process unit 250, the unfixed toner image is transferred to the obverse side of the medium 1.

The medium 1, in which the unfixed toner images were respectively transferred to both the observe and reverse sides, is conveyed by the conveyance system 700. After the medium 1 has passed the first turn roller pair 40 and the light shielding portion 43, the toner image transferred to the reverse side is fixed by the first fixing section 410.

Thereafter, the medium 1 is conveyed by the conveyance system 700. After the conveying direction has been turned by the second turn roller 51, in the second fixing section 420 the toner image transferred to the obverse side is fixed.

Furthermore, the medium 1 is conveyed by the conveyance system 700, while it is being guided by the guide rollers 76. In the stacker 60, the medium 1 is swung by the swing guide 61. With this, the mountain folds and valley folds are alternately repeated at the perforations and the medium 1 is stacked in an alternately folded state in the stacker portion 62.

Note that in performing printing on the obverse side of the medium 1 in the obverse printing mode by this apparatus, a printing process similar to the aforementioned duplex printing is performed with the transfer section 212 and medium 1 in the first transferring process unit 250 moved away from the photosensitive drum 211.

Also, in performing printing on the reverse side of the medium 1 in the reverse printing mode by this apparatus, a printing process similar to the aforementioned duplex printing is performed with the transfer section 212 and medium 1 in the second transferring process unit 260 moved away from the photosensitive drum 211.

FIGS. 3A to 3K are timing charts showing the state of each part when the duplex printing apparatus as an embodiment of the present invention makes a switch-over from the obverse printing mode to the double-side printing mode, while FIGS. 4A to 4K are timing charts showing the state of each part when a switch-over is made from that double-side printing mode to the reverse printing mode. With these FIGS. 3A to 3K and 4A to 4K, a description will be made of the control method of the apparatus in the case where the printing modes are switched.

Here, FIGS. 3A and 4A show the rotating state (positive rotation or reverse rotation) of the conveyor tractor 710, FIGS. 3B and 4B show the rotating state (ON or OFF) of the photosensitive drum 211 of the second transferring process unit 260, FIGS. 3C and 4C show the rotating state (ON or OFF) of the photosensitive drum 211 of the first transferring process unit 250, FIGS. 3D and 4D show the operational state (set or release) of the moving mechanism 230 of the second transferring process unit 260, FIGS. 3E and 4E show the operational state (set or release) of the moving mechanism 230 of the first transferring process unit 250, FIGS. 3F and 4F show the transferring state (ON or OFF) of the transfer section 212 of the second transferring process unit 260, FIGS. 3G and 4G show the transferring state (ON or OFF) of the transfer section 212 of the first transferring process unit 250, FIGS. 3H and 4H show the rotating state of the transfer guide roller 77 of the second transferring process unit 260, FIGS. 3I and 4I show the rotating state of the first turn roller pair 40, FIGS. 3J and 4J show the rotating state of the conveyor roller (not shown), and FIGS. 3K and 4K show the rotating state of the back tension roller 71.

In this apparatus, when a switch-over is made between the printing modes, each component is controlled by the control section 1100. For example, in making a switch-over from the one-side printing mode (e.g., obverse printing mode) to the double-side printing mode, as shown at point A2 in FIG. 3A and at point A3 in FIG. 3J, the medium 1 is subsequently rotated in the conveying direction for printing by the conveyor tractor 710 and the conveyor rollers (not shown), after the toner image has been formed and transferred to the obverse side of the medium 1 by the second transferring process unit 260, as shown at point A1 in FIG. 3F. With this, the unfixed toner image on the obverse side of the medium 1, formed by the second transferring process unit 260, is conveyed to the second fixing section 420, in which the unfixed toner image is fixed.

Note that the rotation of each roller in the conveying direction for printing will hereinafter be referred to as "positive rotation." Also, the rotation in the opposite direction from the conveying direction for printing will hereinafter be referred to as "reverse rotation." In FIGS. 3 and 4, the rotational directions are also displayed as "positive rotation" and "reverse rotation."

Also, during the conveyance of the medium 1 in the conveying direction for printing, if the conveying speed of the medium 1 is assumed to be Vh (e.g., Vh=587.9629 mm/sec), the back tension roller 71 positively rotates at a slower rotational speed than the conveying speed Vh of the medium 1 (e.g., speed 0.95 times the conveying speed (=Vh×0.95)), as shown at point A4 in FIG. 3K.

After the lapse of a predetermined time $t_1$ since the obverse side of the medium 1 was fixed by the second fixing section 420, the back tension roller 71 is stopped (see point A5 in FIG. 3K). Here, if the distance of conveyance on the medium 1 from the contacted portion between the transfer charger 212*a* of the second transferring process unit 260 and the medium 1 to the fixing position in the second fixing section 420 is assumed to be $L_1$, the aforementioned predetermined time $t_1$ can be calculated by an equation of $t_1=L_1 \div Vh$.

Thereafter, the rotations of the conveyor tractor 710, the transfer guide roller 77, and the first turn rollers 41 and 42 are stopped, respectively (see point A10 in FIG. 3A, point A7 in FIG. 3H, and point AB in FIG. 3I). Also, with the moving mechanism 230 of the second transferring process unit 260, the medium 1 and the transfer section 212 are moved away from the photosensitive drum 211 of the second transferring process unit 260 (see point A6 in FIG. 3D).

Note that in FIGS. 3D and 3E and FIGS. 4D and 4E, "set" represents the state in which the medium 1 and the transfer section 212 are moved close to the photosensitive drum 211 by the moving mechanism 230, while "release" represents the state in which the medium 1 and the transfer section 212 are moved away from the photosensitive drum 211 by the moving mechanism 230.

Also, the conveyor tractor 710 is stopped and the photosensitive drum 211 of the second transferring process unit 260 is stopped. Note that at this time, if the photosensitive drum 211 is stopped drastically, there is a possibility that the toner on the drum surface will scatter in different directions. For this reason, in accordance with a predetermined process stopping sequence for the photosensitive drum 211, the rotation of the photosensitive drum 211 is gradually stopped so that the toner on the drum surface does not scatter in different directions (see points A11 to A17 in FIG. 3B).

Furthermore, the back tension roller 71 is rotated in reverse at a speed 1.05 times the conveying speed of the medium 1 for printing (Vh×1.05) (see point A9 in FIG. 3K).

The transfer guide roller 77 and the first turn rollers 41 and 42 are positively rotated at a speed one-fourth the speed at positive rotation (Vgr×¼) and a speed one-fourth the speed at positive rotation (Vor×¼), respectively (see point A12 in FIG. 3H and point A13 in FIG. 3I).

Next, at the same time the conveyor tractor 710 is rotated in reverse (see point A14 in FIG. 3A), the conveyor rollers (not shown) are stopped (see point A15 in FIG. 3J), and a little later, the conveyor rollers are rotated in reverse (see point A16 in FIG. 3J). With this, the conveyor tractor 710 and the conveyor rollers feed back the medium 1, thereby conveying the foremost end position of the unprinted portion (the rearmost end position of the toner image) on the obverse side of the medium 1 to the printing start position in the first transferring process unit 250.

Note that at the time of the back feed, by stopping the conveyor rollers later than the conveyor tractor 710, or by making the reverse rotation start of the conveyor tractor 710 later than that of the conveyor rollers, looseness can be prevented from occurring in the medium 1 when the conveying direction of the medium 1 is turned.

After a desired position on the medium 1 has been conveyed to the printing start position in the first transferring process unit 250, the reverse rotation of the conveyor tractor 710 is stopped (see point A18 in FIG. 3A). Also, with current applied to each motor, the transfer guide roller 77, the first turn rollers 41 and 42, and the back tension roller 71 are caused to wait in a detent state of holding the position of each roller (see point A19 in FIG. 3H, point A20 in FIG. 3I, and point A21 in FIG. 3K). In this state, it is judged that the conveyance of the medium 1 has temporarily been stopped.

After the stop of the medium conveyance, in order to start duplex printing, the photosensitive drums 211 of the second and first transferring process units 260 and 250 are each rotated after the lapse of a predetermined time (see point A22 in FIG. 3B and point A23 in FIG. 3C). Next, the conveyor rollers are positively rotated (see point A24 in FIG. 3J). Thereafter, the conveyor tractor 710 is positively rotated to start the conveyance of the medium 1 in the conveying direction for printing (see point A25 in FIG. 3A).

At the same time as the positive rotation start of the conveyor tractor 710, the transfer sections 212 are set by the moving mechanisms 230 of the second and first transferring process units 260 and 250, respectively (see point A26 in FIG. 3D and point A27 in FIG. 3E)e. Also, the transfer guide roller 77 and the first turn rollers 41 and 42 are positively rotated at normal rotational speeds (Vgr and Vor), respectively (see point A28 in FIG. 3H and point A29 in FIG. 3I). Furthermore, formation of the toner images on both the obverse and reverse sides of the medium 1 is started by the transfer sections 212 of the first and second transferring process units 250 and 260 (see point A30 in FIG. 3F and point A31 in FIG. 3G).

Note that when duplex printing is started, the occurrence of looseness in the medium 1 can be prevented by positively rotating the conveyor tractor 710 after positive rotation of the conveyor rollers. In addition, by causing the transfer guide roller 77, the first turn rollers 41 and 42, and the back tension roller 71 to wait in a detent state, there is no possibility that the position of each roller at the restart of conveyance of the medium 1 will shift when duplex printing is started.

Furthermore, after the lapse of a predetermined time $t_2$ since the conveyance start of the medium 1 by the conveyor tractor 710, the back tension roller 71 is positively rotated at a speed such that the conveying speed becomes Vh×0.95 (see point A32 in FIG. 3K). Hereinafter, printing is performed on both the obverse and reverse sides of the medium 1 in the double-side printing mode.

Next, with FIGS. 4A to 4K, a description will be made of the control method of this apparatus in the case where a switch-over is made from the double-side printing mode to the one-side printing mode.

In the duplex printing apparatus of the present invention, in making a switch-over from the double-side printing mode to the one-side printing mode (e.g., obverse printing mode), the medium 1 is positively rotated subsequently by the conveyor tractor 710 and the conveyor rollers after the transfer completion of the toner image to the reverse side of the medium 1 by the first transferring process unit 250 and the transfer completion of the toner image to the obverse side of the medium 1 by the second transferring process unit 260 (see point B1 in FIG. 4G and point B2 in FIG. 4F). With this, the unfixed toner image on the reverse side of the medium 1, formed by the first transferring process unit 250, is conveyed to the first fixing section 410. Also, the unfixed toner image on the obverse side of the medium 1 formed by the second transferring process unit 260 is conveyed to the second fixing section 420. In the first and second fixing sections 410 and 420, the unfixed toner images on both the obverse and reverse sides of the medium 1 are fixed, respectively.

Note that, during the conveyance of the medium 1 in the conveying direction for printing, if the conveying speed of the medium 1 is assumed to be Vh (e.g., Vh=587.9629 mm/sec), the back tension roller 71 positively rotates at a slower rotational speed than the conveying speed Vh of the medium 1 (e.g., speed 0.95 times the conveying speed (=Vh×0.95), as shown at point B3 in FIG. 4K.

Thereafter, the back tension roller 71 is stopped (see point B3 in FIG. 4K). Furthermore, after the lapse of a predetermined time $t_3$since the transfer by the first transferring process unit 250 ended, the conveyor tractor 710, the transfer guide roller 77 and the first turn rollers 41 and 42 are stopped (see point B4 in FIG. 4A, point B8 in FIG. 4H and point B9 in FIG. 4I). Also, the medium 1 and the transfer section 212 are moved from the photosensitive drums 211 of the first and second transferring process units 250 and 260 by the moving mechanisms 230 of the first and second transferring process units 250 and 260 (see point B6 in FIG. 4D and point B7 in FIG. 4E).

Here, if the distance of conveyance on the medium 1 from the contacted portion between the transfer charger 212*a* of the first transferring process unit 250 and the medium 1 to the fixing position in the second fixing section 420 is assumed to be $L_2$, the aforementioned predetermined time $t_3$ can be calculated by an equation of $t_3=L_2 \div Vh$.

Also, the conveyor tractor 710 is stopped and the photosensitive drum 211 of the first transferring process unit 250 is stopped. Note that at this time, if the photosensitive drum 211 is stopped drastically, there is possibility that the toner on the drum surface will scatter in different directions. For this reason, in accordance with a predetermined process stopping sequence for the photosensitive drum 211, the rotation of the photosensitive drum 211 is gradually stopped so that the toner on the drum surface does not scatter in different directions (see the interval between point B15 to point B16 in FIG. 4B).

Also, the photosensitive drum 211 of the second transferring process unit 260 continues to rotate without being stopped (see FIG. 4B).

Furthermore, the back tension roller 71 is rotated in reverse at a speed 1.05 times the conveying speed of the medium 1 for printing (Vh×1.05) (see point B5 in FIG. 4K).

The transfer guide roller 77 and the first turn rollers 41 and 42 are positively rotated at a speed one-fourth the speed at positive rotation (Vgr×¼) and a speed one-fourth the speed at positive rotation (Vor×¼), respectively (see point B10 in FIG. 4H and point B11 in FIG. 4I).

Next, at the same time the conveyor tractor 710 is rotated in reverse (see point B12 in FIG. 4A), the conveyor rollers (not shown) are stopped (see point B13 in FIG. 4J), and at a little later, the conveyor rollers are rotated in reverse (see point B14 in FIG. 4J). With this, the conveyor tractor 710 and the conveyor rollers feed back the medium 1, thereby conveying the foremost end position of the unprinted portion on the obverse side of the medium 1 to the printing start position in the first transferring process unit 250.

Note that at the time of the back feed, by stopping the conveyor rollers later than the conveyor tractor 710, or by making the reverse rotation start of the conveyor rollers later than that of the conveyor tractor 710, looseness can be prevented from occurring in the medium 1 when the conveying direction of the medium 1 is turned.

After a desired position on the medium 1 has been conveyed to the printing start position in the first transferring process unit 250, the reverse rotation of the conveyor tractor 710 is stopped (see point B17 in FIG. 4A). Also, with current applied to each motor, the transfer guide roller 77, the first turn rollers 41 and 42, and the back tension roller 71 are caused to wait in a detent state of holding the position of each roller (see point B18 in FIG. 4H, point B19 in FIG. 4I, and point B20 in FIG. 4K). In this state, it is judged that the conveyance of the medium 1 has temporarily been stopped.

After the stop of the medium conveyance, in order to start one-side printing (obverse printing), the conveyor rollers are positively rotated (see point B21 in FIG. 4J). Thereafter, the conveyor tractor 710 is positively rotated to start the conveyance of the medium 1 in the conveying direction for printing (see point B22 in FIG. 4A).

At the same time as the positive rotation start of the conveyor tractor 710, the moving mechanism 230 of the second transferring process unit 260 is set (see point B23 in FIG. 4D). Also, the transfer guide roller 77 and the first turn rollers 41 and 42 are positively rotated at normal rotational speeds (Vgr and Vor), respectively (see point B25 in FIG. 4H and point B26 in FIG. 4I). Furthermore, formation of the toner image on the obverse side of the medium 1 is started by the transfer section 211 of the second transferring process unit 260 (see point B24 in FIG. 4G).

Note that when duplex printing is started, the occurrence of looseness in the medium 1 can be prevented by positively rotating the conveyor tractor 710 after positive rotation of the conveyor rollers. In addition, by causing the transfer guide roller 77, the first turn rollers 41 and 42, and the back tension roller 71 to wait in a detent state, there is no possibility that the position of each roller at the restart of conveyance of the medium 1 will shift when duplex printing is stared.

Furthermore, after the lapse of a predetermined time $t_4$ since the conveyance start of the medium 1 by the conveyor tractor 710, the back tension roller 71 is positively rotated at a speed such that the conveying speed becomes Vh×0.95 (see point B27 in FIG. 4K). Hereinafter, printing is performed on the obverse side of the medium 1 in one-side printing mode (obverse printing mode).

Note that, in the above-mentioned embodiment, while the control method in the case where a switch-over is made from the obverse printing mode to the double-side printing mode has been described by FIG. 3 and also the control method in the case where a switch-over is made from the double-side printing mode to the obverse printing mode has been described by FIG. 4, the various operational controls by the control section 1100 are also performed in the same manner as the aforementioned, even when a switch-over from the reverse printing mode to the double-side printing mode is made, when a switch-over from the obverse printing mode to the reverse printing mode is made, when a switch-over from the reverse printing mode to the obverse printing mode is made, and when a switch-over from the double-side printing mode to the reverse printing mode is made.

Thus, according to the duplex printing apparatus and the method thereof as an embodiment of the present invention, the following operational effects can be obtained:

(1) In making a switch-over between printing modes, the control section 1100 fixes by the first fixing section 410 or the second fixing section 420 the unfixed toner image on the medium 1 formed in the printing mode preceding before the switch-over and then conveys the medium 1 to the printing start position in the printing mode following after the switch-over by the conveyance system 700. Therefore, there is no occurrence of an unprinted wasteful portion in the medium 1, which is economical. Also, when the medium 1 with the transferred toner image is conveyed to the printing start position in the printing mode following after the switch-over, the toner image formed on the medium 1 has already been fixed. Therefore, even if the medium 1 abutted either the first turn roller pair 40, the second turn roller 51, the transfer guide roller 77, the first transferring process unit 250, the second transferring process unit 260 or the like, there will be no disturbance of the toner image formed on the medium 1 and there will be no reduction in the printing quality of the medium 1.

(2) When a switch-over is made from the double-side printing mode to either the obverse printing mode or the reverse printing mode, the toner image formed on the medium 1 has already been fixed. Therefore, in the printing mode following after the switch-over, even if the transfer section 212 in either unused unit of the first transferring process unit 250 or the second transferring process unit 260 were moved away from the photosensitive drum 211 by the moving mechanism 230, at the time of the separation of the transfer section 212 there will be no disturbance of the toner image formed on the medium 1 and there will be no reduction in the printing quality of the medium 1.

(3) In the obverse printing mode and the reverse printing mode, in either unused unit of the first transferring process unit 250 or the second transferring process unit 260, the transfer section 212 and the medium 1 can be moved away from the photosensitive drum 211 by the moving mechanism 230. Therefore, in the printing mode after the switch-over, the transfer section 212 and the medium 1 are moved away from the photosensitive drum 211 on the side of either unused unit of the first transferring process units 250 or the second transferring process unit 260 by the moving mechanism 230. With this, degradation due to friction between the photosensitive drum 211 and the medium 1 can be prevented and the photosensitive drum 211 can be prolonged in service life. Thus, there is an economical advantage.

(4) Since the conveyance system 700 rotates the transfer guide roller 77 and the first turn rollers 41 and 42 in the conveying direction for printing even at the time of the back feed of the medium 1, wears on the transfer guide roller 77 and the first turn rollers 41 and 42 in one direction due to friction with the medium 1 can be prevented and vibration and malfunction can be prevented during conveyance of the medium 1. Since vibration and malfunction can be prevented during conveyance of the medium 1, apparatus reliability can be enhanced. In addition, since the toner attached to each roller surface can be evenly removed by the blade, there is no reduction in the printing quality of the medium.

(5) Since the first turn rollers 41 and 42 and the transfer guide roller 77 rotate in the conveying direction for printing even at the time of the back feed of the medium 1, no excessive force acts between each of the cleaning blades, provided in the transfer guide roller 77 and the first turn rollers 41 and 42, and the corresponding roller of these rollers at the time of the back feed. In addition, even at the time of the back feed, the toner attached to each surface of these rollers can be scraped.

(6) At the time of the back feed, tension can be applied to the medium 1 in the opposite direction from the conveying direction for printing, by rotating the transfer guide roller 77 and the first turn rollers 41 and 42 in the conveying direction for printing at a slower speed than the conveying speed for printing (e.g., a speed about ¼ the conveying speed for printing). Therefore, the medium 1 can be fed back in a stable state, while it is being tensioned. In addition, there is no possibility that the transfer guide roller 77 and the first turn rollers 41 and 42 will wear away in one direction. Therefore, since vibration and malfunction can be prevented during conveyance of the medium 1, apparatus reliability can be enhanced.

(7) In the conveyance system 700, when the medium 1 is conveyed in the conveying direction for printing, the drive motor 714 rotates the drive-side pressure roller 712 (back tension roller 71) in the opposite direction from the conveying direction for printing. Therefore, when the medium 1 is conveyed in the conveying direction for printing, tension can be applied to the medium 1 in the opposite direction from the conveying direction for printing to tension the medium 1. Therefore, the medium 1 can be fed back in a stable state.

(8) In the conveyance system 700, at the time of the back feed, the drive motor 714 rotates the drive-side pressure roller 712 (back tension roller 71) in the direction opposite from the conveying direction for printing so that the circumferential speed of the drive-side pressure roller 712 becomes faster than the conveying speed of the medium 1. With this, at the time of the back feed, tension can be applied to the medium 1 in the opposite direction from the conveying direction for printing to tension the medium 1 and therefore the medium 1 can be fed back in a stable state.

(9) The conveyance system 700 conveys the medium 1 in the order of first transferring process unit 250, second transferring process unit 260, first fixing section 410, and second fixing section 420. Also, the second transferring process unit 260 is disposed above the first transferring process unit 250, and the first fixing section 410 is disposed above the second transferring process unit 260. With this, the first transferring process unit 250 and the second transferring process unit 260 can be constituted by the common structure. Therefore, development costs and manufacturing costs can be reduced and an area for apparatus installation can be reduced.

(10) The second fixing section 420 is disposed on a downstream side from the first fixing section 410. Also, the second turn roller 51 is disposed between the first and second fixing sections 410 and 420. Furthermore, the conveying path of the medium 1 is turned at the second turn roller 51 by a predetermined angle or more. Therefore, the height of the conveying path of the medium 1 can be made low, apparatus miniaturization can be realized, and operator's operability can be enhanced.

(11) The first fixing section 410 and the second fixing section 420 are enclosed with the duct 83, which is connected to the blower 8 so that smoke and an offensive smell, produced in the first and second fixing sections 410 and 420 and consisting of organic high molecular compounds such as styrene, butadiene, phenol and the like, are collected. Also, each of the toner-hopper-attached developing units 219 of the first and second transferring process units 250 and 260 is equipped with a developer counter (not shown). This developer counter counts up, each time printing is performed. A controller (not shown) compares the count value with a previously recorded predetermined value. Therefore, the time for exchanging the filter 82 can be easily judged. As a result, maintenance becomes easy and operability is enhanced.

(12) In the conveyance system 700, the conveyor tractor 710 is constituted by a plurality (in this embodiment, two mechanisms) of tractor mechanisms 72 and 73. These tractor mechanisms 72 and 73 are constructed so as to have constitution common to each other. Therefore, the cost for manufacturing the conveyor tractor 710 can be reduced.

(13) Between the driving shaft 722 of the tractor mechanism 72 and the driving shaft 722 of the tractor mechanism 73, the driving belt 725 is looped. By connecting the driving shaft 722 of the tractor mechanism 72 to the driving motor 724, the tractor mechanisms 72 and 73 can be reliably driven in synchronization with each other. Therefore, the medium 1 can be stably conveyed and apparatus reliability can be enhanced.

(14) The conveyance system 700 is disposed on an upstream side from the first transferring process unit 250, and the conveyor tractor 710 is constituted by a plurality of tractor mechanisms 72 and 73. Therefore, when the medium 1 is set in this apparatus, there is no need for the operator to reach his hand up to the first transferring process unit 250, which is disposed at a relatively deeper position of the apparatus when viewed from the paper hopper 10, in order to set the medium 1. Therefore, the operability for setting the medium 1 can be enhanced. In addition, the medium 1 can be reliably conveyed and apparatus reliability can be enhanced.

(15) The tractor mechanisms 72 and 73 and the driving motor 724 are constructed so that they can convey the medium 1 in both the conveying direction for printing and the opposite direction from the conveying direction. Therefore, in the case where a problem such as a jam of the medium 1 has occurred, when recovery operation is performed to reprint where the problem has occurred, printing can be restarted at a desired position on the medium 1, by conveying the medium 1 in the opposite direction from the conveying direction for printing.

(16) The conveyor tractor 710 conveys the medium 1 at a speed greater than the conveying speed for printing in conveying it in the opposite direction from the conveying direction for printing. Therefore, when the above-mentioned recovery operation is performed due to the occurrence of a problem such as the occurrence of paper jam, printing can be restarted quickly.

(17) The back tension roller 71 is constituted by a pair of the driving-side pressure roller 712 and the driven-side pressure roller 711. With this, the medium pressure section can be realized, which is economical.

(18) When the back tension roller 71 conveys the medium 1 in the conveying direction for printing with the medium 1 held between the drive-side pressure roller 712 and the driven-side pressure roller 711, the driving motor 714 rotates the driving-side pressure roller 712 in the conveying direction for printing so that the circumferential speed of the roller 712 becomes slower than the conveying speed of the medium 1 for printing. With this, tension is produced in the medium 1 in the opposite direction from the conveying direction for printing. Therefore, the medium can always be tensioned. As a result, there is no possibility that the medium 1 will loosen at the first transferring process unit 250, the second transferring process unit 260, etc. Furthermore, high quality printing can be performed, the occurrence of a problem such as a jam can be prevented, and apparatus reliability can be enhanced.

(19) In conveying the medium 1 in the opposite direction from the conveying direction for printing, the driving motor 714 rotates the driving-side pressure roller 712 in the opposite direction from the conveying direction for printing so that the circumferential speed of the roller 712 becomes faster than the conveying speed of the medium 1 for printing. With this, tension is produced in the medium 1 in the conveying direction for printing. Therefore, the medium can always be tensioned. As a result, there is no possibility that the medium 1 will loosen in the conveying path of the medium 1. Furthermore, the occurrence of a problem such as a jam can be prevented and apparatus reliability can be enhanced.

(20) The exhaust toner, collected by the cleaning section 220, is discharged by the exhaust toner screw 221, which is rotated by a drive motor (not shown), and is collected in the exhaust toner collector (spent toner cartridge 217). With this, the exhaust toner, collected at the first and second transferring process units 250 and 260, can easily be collected and the operability of maintenance operation can be enhanced.

(21) Since the spent toner cartridge 217 is reused as the exhaust toner collector, there is no need to develop and manufacture an exclusive exhaust toner collector. Therefore, manufacturing costs and operational costs can be reduced.

(22) One-side printing may be performed with the second transferring process unit 260, the second fixing section 420, and the conveyance system 700. With this, components can be shared between a duplex printing apparatus and a one-side printing apparatus and therefore the time and costs for development and manufacture can be reduced.

Note that in the above-mentioned embodiment, the conveyance system 700 has the first turn roller 42, which is a roll that rotates in the conveying direction of the medium 1 for printing while contacting the unfixed toner image formed on the medium 1 during printing. Also, the medium 1 is wound around this first turn roller 42 by a predetermined angle. The side of the medium 1 contacting the first turn roller 42 is the obverse of the medium 1. However, the present invention is not limited to this arrangement, but may be variously modified and executed without departing from the gist of the present invention.

For instance, in the case where the conveyance system 700 has the first turn roller 42 which is a roll that rotates in the conveying direction of the medium 1 for printing while contacting the unfixed toner image formed on the medium 1 during printing, the opposite side of the medium 1 from the first turn roller 42 may be the obverse side of the medium 1. In this case, the obverse side of the medium 1 is printed with the first transferring process unit 250 and the first fixing section 410, while the reverse side is printed with the second transferring process unit 260 and the second fixing section 420.

With this, there is no possibility that the toner image, formed on the obverse side of the medium 1, will be disturbed by contact with the first turn roller 42 and therefore high printing quality can be maintained in the printing of the obverse side of the medium 1 that is frequently performed as compared with the reverse side of the medium 1.

Also, the reverse side of the medium 1 may contact the first turn roller 41 and the medium 1 may be wound around this first turn roller by a predetermined angle. In this case, the reverse side of the medium 1 is printed with the first transferring process unit 250 and the first fixing section 410, while the obverse side is printed with the second transferring process unit 260 and the second fixing section 420.

With this, the height of the conveying path of the medium 1 can be reduced and the apparatus can be reduced in size.

Furthermore, in the above-mentioned embodiment, while the toner image formed on the medium 1 is flash fixed with the fixing sections 410 and 420, the present invention is not limited to this, but may be variously modified and executed without departing from the gist of the present invention. For example, the toner image formed on the medium 1 may be fixed with a heating roller.

In addition, in the above-mentioned embodiment, although the first and second fixing sections 410 and 420 are arranged at different positions on the conveying path of the medium 1, i.e., the second fixing section 420 is arranged on a downstream side from the first fixing section 410 so that the toner images, formed on the obverse and reverse sides of the medium 1, are fixed at different positions, the present invention is not limited to this, but may be variously modified and executed without departing from the gist of the present invention. For example, the first and second fixing sections 410 and 420 may be arranged across the medium 1 at the same position on the conveying path of the medium 1 downstream from the first and second transferring process units 250 and 260. Also, instead of the first and second fixing sections 410 and 420, a fixing section for fixing the toner images formed on the obverse and reverse sides of the medium 1 at the same time may be arranged on at a position on the conveying path of the medium 1 downstream from the first and second transferring process units 250 and 260.

What is claimed is:

1. A duplex printing apparatus for performing printing on both sides of a medium, comprising:

a first image forming process unit for forming a toner image on the reverse of the medium;

a second image forming process unit disposed at a position separated from said first image forming process unit for forming another toner image on the obverse of the medium;

a fixing section disposed downstream of said first image forming process unit with respect to the medium conveying direction for fixing said toner images formed on the both sides of the medium;

a conveyance system for conveying the medium to said first image forming process unit, said second image forming process unit, and said fixing section one after another; and a control section for controlling said apparatus so as to perform printing in a selective one of three printing modes which consist of an obverse printing mode in which printing of the second-named toner image is to be made by said second image forming process unit, a reverse printing mode in which printing of the first-named toner image is to be made on only the reverse of the medium by said first image forming process unit, and a double-side printing mode in which printing of the first and second-named toner images are to be made on both the reverse and obverse of the medium by said first and second image forming process units;

wherein, in making a switch-over between said printing modes, said control section being operable to cause said fixing section to fix the unfixed toner image on the medium formed in the printing mode preceding before the switch-over and then conveys the medium by said conveyance system to a printing start position in the printing mode following after the switch-over.

2. The duplex printing apparatus as set forth in claim 1, wherein in making a switch-over from either said obverse printing mode or said reverse printing mode to said double-side printing mode, said control section is operable to cause said fixing section to fix the unfixed toner image on the both sides of said medium formed by said second or first image forming process unit and then feeds back the medium to a printing start position in said first or second image forming process unit by said conveyance system.

3. The duplex printing apparatus as set forth in claim 1, wherein in making a switch-over from said double-side printing mode either to said obverse printing mode or said reverse printing mode, said control section is operable to cause said fixing section to fix the unfixed toner images on the both sides of the medium formed by said first and second image forming process units and then feeds back the medium to printing start positions in said first and second image forming process units by said conveyance system.

4. The duplex printing apparatus as set forth in claim 2, wherein in making a switch-over from said double-side printing mode either to said obverse printing mode or said reverse printing mode, said control section is operable to cause said fixing section to fix the unfixed toner images on the both sides of the medium formed by said first and second image forming process units and then feeds back said medium to printing start positions in said first and second image forming process units by said conveyance system.

5. The duplex printing apparatus as set forth in claim 2, further comprising a moving mechanism for moving the medium and each of image forming drums in said first and second image forming process units toward and away from each other, said moving mechanism being controllable so that the medium is moved away from said image forming drum.

6. The duplex printing apparatus as set forth in claim 3, further comprising a moving mechanism for moving the medium and each of image forming drums in said first and second image forming process units toward and away from each other, said moving mechanism being controllable so that the medium is moved away from said image forming drum.

7. The duplex printing apparatus as set forth in claim 4, further comprising a moving mechanism for moving the medium and each of image forming drums in said first and second image forming process units toward and away from each other, said moving mechanism being controllable so that the medium is moved away from said image forming drum.

8. The duplex printing apparatus as set forth in claim 2, wherein said conveyance system is equipped with a blade-abutted roller including a roller which is rotatable in only one direction to convey the medium while abutting the unfixed toner image formed on the medium during printing and a fixed blade abutting against a circumferential surface of said roller at a predetermined angle, said blade-abutted roller being rotatable in said one direction even when the medium is fed back.

9. The duplex printing apparatus as set forth in claim 3, wherein said conveyance system is equipped with a blade-abutted roller including a roller which is rotatable in only one direction to convey the medium while abutting the unfixed toner image formed on the medium during printing and a fixed blade abutting against a circumferential surface of said roller at a predetermined angle, said blade-abutted roller being rotatable in said one direction even when the medium is fed back.

10. The duplex printing apparatus as set forth in claim 4, wherein said conveyance system is equipped with a blade-abutted roller including a roller which is rotatable in only one direction to convey the medium while abutting the unfixed toner image formed on the medium during printing and a fixed blade abutting against a circumferential surface of said roller at a predetermined angle, said blade-abutted roller being rotatable in said one direction even when the medium is fed back.

11. The duplex printing apparatus as set forth in claim 5, wherein said conveyance system is equipped with a blade-abutted roller including a roller which is rotatable in only one direction to convey the medium while abutting the unfixed toner image formed on the medium during printing and a fixed blade abutting against a circumferential surface of said roller at a predetermined angle, said blade-abutted roller being rotatable in said one direction even when the medium is fed back.

12. The duplex printing apparatus as set forth in claim 6, wherein said conveyance system is equipped with a blade-abutted roller including a roller which is rotatable in only one direction to convey the medium while abutting the unfixed toner image formed on the medium during printing and a fixed blade abutting against a circumferential surface of said roller at a predetermined angle, said blade-abutted roller being rotatable in said one direction even when the medium is fed back.

13. The duplex printing apparatus as set forth in claim 7, wherein said conveyance system is equipped with a blade-abutted roller including a roller which is rotatable in only one direction to convey the medium while abutting the unfixed toner image formed on the medium during printing and a fixed blade abutting against a circumferential surface of said roller at a predetermined angle, said blade-abutted roller being rotatable in said one direction even when the medium is fed back.

14. The duplex printing apparatus as set forth in claim 2, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

15. The duplex printing apparatus as set forth in claim 3, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

16. The duplex printing apparatus as set forth in claim 4, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

17. The duplex printing apparatus as set forth in claim 5, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

18. The duplex printing apparatus as set forth in claim 6, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

19. The duplex printing apparatus as set forth in claim 7, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

20. The duplex printing apparatus as set forth in claim 8, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

21. The duplex printing apparatus as set forth in claim 9, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

22. The duplex printing apparatus as set forth in claim 10, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

23. The duplex printing apparatus as set forth in claim 11, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

24. The duplex printing apparatus as set forth in claim 12, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

25. The duplex printing apparatus as set forth in claim 13, wherein said conveyance system is equipped with a back tension roller which is rotatable in a direction opposite to the medium conveying direction while abutting the medium to apply tension to the medium during printing, said back tension roller being rotatable in said opposite direction when the medium is fed back.

26. The duplex printing apparatus as set forth in claim 8, wherein said blade-abutted roller is rotatable in said one direction at a slower rotational speed than a rotational speed during printing.

27. The duplex printing apparatus as set forth in claim 9, wherein said blade-abutted roller is rotatable in said one direction at a slower rotational speed than a rotational speed during printing.

28. The duplex printing apparatus as set forth in claim 10, wherein said blade-abutted roller is rotatable in said one direction at a slower rotational speed than a rotational speed during printing.

29. The duplex printing apparatus as set forth in claim 11, wherein said blade-abutted roller is rotatable in said one direction at a slower rotational speed than a rotational speed during printing.

30. The duplex printing apparatus as set forth in claim 12, wherein said blade-abutted roller is rotatable in said one direction at a slower rotational speed than a rotational speed during printing.

31. The duplex printing apparatus as set forth in claim 13, wherein said blade-abutted roller is rotatable in said one direction at a slower rotational speed than a rotational speed during printing.

32. The duplex printing apparatus as set forth in claim 14, wherein said back tension roller is rotatable in said opposite direction at a faster rotational speed than a conveying speed of the medium.

33. The duplex printing apparatus as set forth in claim 15, wherein said back tension roller is rotatable in said opposite direction at a faster rotational speed than a conveying speed of the medium.

34. The duplex printing apparatus as set forth in claim 16, wherein said back tension roller is rotatable in said opposite direction at a faster rotational speed than a conveying speed of the medium.

35. The duplex printing apparatus as set forth in claim 17, wherein said back tension roller is rotatable in said opposite direction at a faster rotational speed than a conveying speed of the medium.

36. The duplex printing apparatus as set forth in claim 18, wherein said back tension roller is rotatable in said opposite direction at a faster rotational speed than a conveying speed of the medium.

37. The duplex printing apparatus as set forth in claim 19, wherein said back tension roller is rotatable in said opposite direction at a faster rotational speed than a conveying speed of the medium.

38. The duplex printing apparatus as set forth in claim 20, wherein said back tension roller is rotatable in said opposite direction at a faster rotational speed than a conveying speed of the medium.

39. The duplex printing apparatus as set forth in claim 21, wherein said back tension roller is rotatable in said opposite direction at a faster rotational speed than a conveying speed of the medium.

40. The duplex printing apparatus as set forth in claim 22, wherein said back tension roller is rotatable in said opposite direction at a faster rotational speed than a conveying speed of the medium.

41. The duplex printing apparatus as set forth in claim 23, wherein said back tension roller is rotatable in said opposite direction at a faster rotational speed than a conveying speed of the medium.

42. The duplex printing apparatus as set forth in claim 24, wherein said back tension roller is rotatable in said opposite direction at a faster rotational speed than a conveying speed of the medium.

43. The duplex printing apparatus as set forth in claim 25, wherein said back tension roller is rotatable in said opposite direction at a faster rotational speed than a conveying speed of the medium.

44. The duplex printing apparatus as set forth in claim 1, wherein said conveyance system has a roller which is rotatable in a conveying direction for printing of the medium while contacting the unfixed toner image formed on the medium during printing, the opposite side of the medium from the surface of the medium contacted by said roller being the obverse of the medium.

45. A control method of a duplex printing apparatus for performing printing on both sides of a medium, the apparatus comprising:

a first image forming process unit for forming a toner image on the reverse of the medium;

a second image forming process unit disposed at a position separated from said first image forming process unit for forming another toner image on the obverse side of the medium;

a fixing section disposed downstream of said first image forming process unit with respect to the medium conveying direction for fixing said toner images formed on both sides of the medium; and a conveyance system for conveying the medium to said first image forming process unit, said second image forming process unit, and said fixing section one after another;

the control method comprising the steps of:

performing printing in a selective one of three printing modes which consists of an obverse printing mode in which printing only on the obverse of the medium with said second image forming process unit, a reverse printing mode in which printing only on the reverse of the medium with said first image forming process unit, and a double-side printing mode in which printing on both sides of the medium with said first and second image forming process units; and when a switch-over is made between said printing modes, fixing by said fixing section the unfixed toner image on the medium formed in the printing mode preceding before the switch-over and then conveying the medium by said conveyance system to a printing start position in the printing mode following after the switch-over.

46. The control method of the duplex printing apparatus as set forth in claim 45, wherein in making a switch-over of the printing mode from either said obverse printing mode or said reverse printing mode to said double-side printing mode, the unfixed toner image on the obverse or reverse of the medium, formed by said second or first image forming process unit, is fixed by said fixing section and the medium is fed back to a printing start position in said first or second image forming process unit by said conveyance system.

47. The control method of the duplex printing apparatus as set forth in claim 45, wherein in making a switch-over of the printing mode from said double-side printing mode either to said obverse printing mode or said reverse printing mode, the unfixed toner images on both sides of the medium, formed by said first and second image forming process units, are fixed by said fixing section and the medium is fed back to printing start positions in said first and second image forming process units by said conveyance system.

48. The control method of the duplex printing apparatus as set forth in claim 46, wherein in making a switch-over of the printing mode from said double-side printing mode either to said obverse printing mode or said reverse printing mode, the unfixed toner images on both sides of the medium, formed by said first and second image forming process units, are fixed by said fixing section and the medium is fed back to printing start positions in said first and second image forming process units by said conveyance system.

* * * * *